US009160129B2

(12) United States Patent
Brickner et al.

(10) Patent No.: US 9,160,129 B2
(45) Date of Patent: Oct. 13, 2015

(54) CONNECTORS AND METHODS FOR MANUFACTURING CONNECTORS

(71) Applicant: Apple Inc., Cupertino, CA (US)

(72) Inventors: Michael T. Brickner, Cupertino, CA (US); Simon Harnett, Mountain View, CA (US); Brett A. Rosenthal, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 242 days.

(21) Appl. No.: 13/650,062

(22) Filed: Oct. 11, 2012

(65) Prior Publication Data

US 2014/0068933 A1 Mar. 13, 2014

Related U.S. Application Data

(63) Continuation-in-part of application No. 13/610,631, filed on Sep. 11, 2012, now Pat. No. 9,059,531.

(51) Int. Cl.

| | |
|---|---|
| ***H01R 43/16*** | (2006.01) |
| ***H01R 24/00*** | (2011.01) |
| ***H01R 13/46*** | (2006.01) |
| ***H01R 43/18*** | (2006.01) |
| ***B22D 17/00*** | (2006.01) |
| ***B22D 19/04*** | (2006.01) |

(Continued)

(52) U.S. Cl.

CPC ..... *H01R 43/18* (2013.01); *B22D 17/00* (2013.01); *B22D 19/04* (2013.01); *B24B 7/17* (2013.01); *B24B 41/06* (2013.01); *H01R 13/6581* (2013.01); *H01R 24/60* (2013.01); *Y10T 29/49204* (2015.01)

(58) Field of Classification Search

CPC .... H01R 43/16; H01R 23/7073; H01R 23/02; H01R 23/725; H01R 13/658; G01R 3/00; H04B 1/08

USPC ..... 29/874; 439/660; 174/520

See application file for complete search history.

(56) References Cited

U.S. PATENT DOCUMENTS 2,380,994 A * 8/1945 Pummill ..... 411/270
2,564,029 A * 8/1951 Peterson ..... 411/366.1

(Continued)

FOREIGN PATENT DOCUMENTS

CN 1397804 2/2003
CN 1830122 A 9/2006

(Continued)

OTHER PUBLICATIONS

Office Action for United Kingdom Patent Application No. 1220045.7, mailed on Mar. 7, 2014, 3 pages.

(Continued)

*Primary Examiner* — David Angwin

(74) *Attorney, Agent, or Firm* — Kilpatrick Townsend & Stockton LLP

(57) ABSTRACT

Frames for plug connectors capable of being a reduced size may include features to support contacts, house circuitry for coupling with the contacts, facilitate the flow of molten material during the molding of the frame, and allow for ease of insertion and removal of the plug connector to and from a corresponding receptacle connector. For example, a frame may include ledges, interlocks, and rounded and tapered openings. Methods for manufacturing the frame are also provided.

21 Claims, 19 Drawing Sheets

(51) Int. Cl.

| | |
|---|---|
| ***B24B 41/06*** | (2012.01) |
| ***B24B 7/17*** | (2006.01) |
| *H01R 13/6581* | (2011.01) |
| *H01R 24/60* | (2011.01) |

(56) References Cited

U.S. PATENT DOCUMENTS

| | | | | |
|---|---|---|---|---|
| 2,564,550 | A * | 8/1951 | Tichenor | 411/321 |
| 2,792,557 | A * | 5/1957 | Dowick | 439/105 |
| 2,892,990 | A * | 6/1959 | Werndl | 439/265 |
| 3,760,335 | A * | 9/1973 | Roberts | 439/398 |
| 3,793,614 | A * | 2/1974 | Tachick et al. | 439/88 |
| 3,795,037 | A * | 3/1974 | Luttmer | 29/883 |
| 4,361,375 | A * | 11/1982 | Bailey et al. | 439/357 |
| 4,461,529 | A | 7/1984 | Fariss | |
| 4,558,912 | A * | 12/1985 | Coller et al. | 439/246 |
| 4,621,882 | A * | 11/1986 | Krumme | 439/161 |
| 4,711,506 | A * | 12/1987 | Tanaka | 439/108 |
| 5,040,994 | A * | 8/1991 | Nakamoto et al. | 439/76.1 |
| 5,256,074 | A * | 10/1993 | Tan et al. | 439/108 |
| 5,295,843 | A * | 3/1994 | Davis et al. | 439/108 |
| 5,380,179 | A * | 1/1995 | Nishimura et al. | 419/36 |
| 5,380,225 | A * | 1/1995 | Inaoka | 439/660 |
| 5,387,110 | A * | 2/1995 | Kantner et al. | 439/59 |
| 5,413,442 | A * | 5/1995 | Grey | 411/366.3 |
| 5,442,243 | A * | 8/1995 | Bailey | 307/10.5 |
| 5,518,421 | A * | 5/1996 | Davis | 439/607.5 |
| 5,554,042 | A * | 9/1996 | Denninger | 439/272 |
| 5,594,284 | A * | 1/1997 | Hill et al. | 307/10.5 |
| 5,785,557 | A | 7/1998 | Davis | |
| 5,959,848 | A * | 9/1999 | Groves et al. | 361/809 |
| 5,967,723 | A * | 10/1999 | Duran | 411/121 |
| 5,967,833 | A * | 10/1999 | Cachina | 439/499 |
| 6,074,225 | A * | 6/2000 | Wu et al. | 439/101 |
| 6,086,421 | A * | 7/2000 | Wu et al. | 439/607.35 |
| 6,113,427 | A * | 9/2000 | Wu | 439/607.47 |
| 6,179,627 | B1 * | 1/2001 | Daly et al. | 439/76.1 |
| 6,231,396 | B1 * | 5/2001 | Huang | 439/668 |
| 6,322,394 | B1 * | 11/2001 | Katoh et al. | 439/607.11 |
| 6,364,699 | B1 * | 4/2002 | Hwang et al. | 439/555 |
| 6,410,857 | B1 * | 6/2002 | Gonya | 174/254 |
| 6,482,028 | B2 * | 11/2002 | Kumamoto et al. | 439/498 |
| 6,482,045 | B2 * | 11/2002 | Arai | 439/680 |
| 6,488,520 | B1 * | 12/2002 | Hayes et al. | 439/188 |
| 6,530,793 | B2 * | 3/2003 | Eichhorn et al. | 439/218 |
| 6,692,311 | B1 * | 2/2004 | Kamei et al. | 439/716 |
| 6,716,058 | B2 * | 4/2004 | Youn | 439/535 |
| 6,776,665 | B2 * | 8/2004 | Huang | 439/676 |
| 6,786,763 | B2 * | 9/2004 | Wu | 439/497 |
| 6,846,202 | B1 * | 1/2005 | Schmidt et al. | 439/660 |
| 6,869,320 | B2 * | 3/2005 | Haas et al. | 439/701 |
| 6,902,432 | B2 * | 6/2005 | Morikawa et al. | 439/607.41 |
| 6,948,965 | B2 * | 9/2005 | Kumamoto et al. | 439/358 |
| 6,948,983 | B1 * | 9/2005 | Peng | 439/660 |
| 6,948,984 | B2 | 9/2005 | Chen et al. | |
| 6,962,510 | B1 * | 11/2005 | Chen et al. | 439/660 |
| 6,964,582 | B2 | 11/2005 | Zhuang et al. | |
| 6,981,887 | B1 * | 1/2006 | Mese et al. | 439/244 |
| 6,994,575 | B1 * | 2/2006 | Clark et al. | 439/173 |
| 7,021,971 | B2 * | 4/2006 | Chou et al. | 439/660 |
| 7,040,919 | B2 | 5/2006 | Yao | |
| 7,074,052 | B1 * | 7/2006 | Ni et al. | 439/76.1 |
| 7,094,086 | B2 | 8/2006 | Teicher | |
| 7,094,089 | B2 | 8/2006 | Andre et al. | |
| 7,160,125 | B1 | 1/2007 | Teicher | |
| 7,175,444 | B2 * | 2/2007 | Lang et al. | 439/76.1 |
| 7,192,313 | B2 * | 3/2007 | Sai | 439/660 |
| 7,198,522 | B1 * | 4/2007 | Ho et al. | 439/660 |
| 7,249,978 | B1 * | 7/2007 | Ni | 439/660 |
| 7,361,059 | B2 | 4/2008 | Harkabi et al. | |
| 7,363,947 | B2 | 4/2008 | Teicher | |
| 7,364,445 | B1 * | 4/2008 | Ni et al. | 439/140 |
| 7,387,539 | B2 | 6/2008 | Trenne | |
| 7,396,257 | B2 * | 7/2008 | Takahashi | 439/620.21 |
| 7,407,416 | B1 * | 8/2008 | Rogers et al. | 439/669 |
| 7,435,107 | B2 * | 10/2008 | Masumoto et al. | 439/79 |
| 7,440,286 | B2 | 10/2008 | Hiew et al. | |
| 7,442,091 | B2 * | 10/2008 | Salomon et al. | 439/660 |
| 7,458,825 | B2 * | 12/2008 | Atsmon et al. | 439/78 |
| 7,500,861 | B2 | 3/2009 | Harkabi et al. | |
| 7,537,471 | B2 * | 5/2009 | Teicher | 439/172 |
| 7,549,896 | B2 * | 6/2009 | Zhang et al. | 439/607.01 |
| 7,553,172 | B2 * | 6/2009 | Chiu et al. | 439/131 |
| 7,559,805 | B1 * | 7/2009 | Yi et al. | 439/660 |
| 7,572,153 | B2 | 8/2009 | Trenne | |
| 7,591,657 | B2 | 9/2009 | Teicher | |
| 7,594,827 | B2 | 9/2009 | Takamoto et al. | |
| 7,695,318 | B1 * | 4/2010 | Wang et al. | 439/607.01 |
| 7,716,400 | B2 * | 5/2010 | Raines | 710/74 |
| 7,717,717 | B1 * | 5/2010 | Lai | 439/66 |
| 7,722,409 | B2 | 5/2010 | Takamoto et al. | |
| 7,727,027 | B2 * | 6/2010 | Chiang et al. | 439/660 |
| 7,740,498 | B1 * | 6/2010 | Orsley | 439/218 |
| 7,841,894 | B2 * | 11/2010 | Gong et al. | 439/541.5 |
| 7,865,629 | B1 * | 1/2011 | Tantos et al. | 710/11 |
| 7,872,873 | B2 * | 1/2011 | Hiew et al. | 361/737 |
| 7,892,014 | B2 * | 2/2011 | Amidon et al. | 439/353 |
| 7,918,685 | B1 * | 4/2011 | Kruckenberg | 439/502 |
| 8,007,309 | B2 * | 8/2011 | Fan | 439/376 |
| 8,062,073 | B1 * | 11/2011 | Szczesny et al. | 439/660 |
| 8,109,795 | B2 | 2/2012 | Lin et al. | |
| 8,162,696 | B2 * | 4/2012 | Elbaz et al. | 439/660 |
| 8,246,388 | B2 | 8/2012 | Chen et al. | |
| 8,277,258 | B1 * | 10/2012 | Huang et al. | 439/660 |
| 8,282,417 | B2 * | 10/2012 | Xiao | 439/607.36 |
| 8,287,299 | B2 * | 10/2012 | Ray et al. | 439/353 |
| 8,342,863 | B2 * | 1/2013 | Kondo et al. | 439/108 |
| 8,461,465 | B2 | 6/2013 | Golko et al. | |
| 8,478,913 | B2 * | 7/2013 | Terlizzi et al. | 710/62 |
| 8,517,751 | B1 | 8/2013 | Golko et al. | |
| 8,517,766 | B2 | 8/2013 | Golko et al. | |
| 8,535,075 | B1 | 9/2013 | Golko et al. | |
| 8,545,269 | B2 * | 10/2013 | Ore-Yang | 439/620.22 |
| 8,545,275 | B2 * | 10/2013 | Wang et al. | 439/693 |
| 8,561,879 | B2 * | 10/2013 | Jol et al. | 228/179.1 |
| 8,573,995 | B2 | 11/2013 | Golko et al. | |
| 8,647,156 | B2 | 2/2014 | Golko et al. | |
| 8,686,600 | B2 | 4/2014 | Terlizzi et al. | |
| 8,688,876 | B1 * | 4/2014 | Fritchman et al. | 710/69 |
| 8,708,745 | B2 | 4/2014 | Golko et al. | |
| 8,762,605 | B2 * | 6/2014 | Terlizzi et al. | 710/62 |
| 8,777,666 | B2 * | 7/2014 | Golko et al. | 439/607.34 |
| 8,882,524 | B2 | 11/2014 | Golko et al. | |
| 8,911,260 | B2 | 12/2014 | Golko et al. | |
| 8,931,962 | B2 | 1/2015 | Jol et al. | |
| 8,998,632 | B2 | 4/2015 | Golko et al. | |
| 2001/0046809 | A1 * | 11/2001 | Chiran et al. | 439/607 |
| 2002/0081880 | A1 | 6/2002 | Eichhorn et al. | |
| 2003/0012677 | A1 * | 1/2003 | Senini | 419/6 |
| 2003/0016509 | A1 * | 1/2003 | Tsukamoto | 361/760 |
| 2003/0207606 | A1 * | 11/2003 | Ho | 439/346 |
| 2004/0229515 | A1 * | 11/2004 | Kaneda et al. | 439/668 |
| 2004/0259423 | A1 | 12/2004 | Elbaz et al. | |
| 2005/0032426 | A1 * | 2/2005 | Tanaka | 439/607 |
| 2005/0042930 | A1 * | 2/2005 | Harkabi et al. | 439/660 |
| 2005/0079738 | A1 | 4/2005 | Ahn | |
| 2005/0085136 | A1 * | 4/2005 | Zhang et al. | 439/700 |
| 2005/0124217 | A1 * | 6/2005 | Zhuang et al. | 439/607 |
| 2005/0124218 | A1 * | 6/2005 | Chen et al. | 439/607 |
| 2005/0124219 | A1 * | 6/2005 | Chen et al. | 439/607 |
| 2005/0202727 | A1 * | 9/2005 | Andre et al. | 439/660 |
| 2006/0019545 | A1 * | 1/2006 | Moriyama et al. | 439/660 |
| 2006/0024997 | A1 * | 2/2006 | Teicher | 439/217 |
| 2006/0040549 | A1 * | 2/2006 | Yao | 439/502 |
| 2006/0148300 | A1 * | 7/2006 | Huang et al. | 439/353 |
| 2006/0216991 | A1 * | 9/2006 | Boutros | 439/607 |
| 2006/0250764 | A1 * | 11/2006 | Howarth et al. | 361/683 |
| 2006/0289201 | A1 * | 12/2006 | Kim et al. | 174/261 |
| 2007/0010115 | A1 | 1/2007 | Teicher | |
| 2007/0010116 | A1 | 1/2007 | Teicher | |
| 2007/0037452 | A1 * | 2/2007 | Martin et al. | 439/638 |
| 2007/0049100 | A1 * | 3/2007 | Tsai | 439/352 |
| 2007/0072442 | A1 * | 3/2007 | DiFonzo et al. | 439/39 |
| 2007/0082701 | A1 * | 4/2007 | Seil et al. | 455/557 |

(56) References Cited

U.S. PATENT DOCUMENTS

| | | | | |
|---|---|---|---|---|
| 2007/0178771 | A1* | 8/2007 | Goetz et al. | 439/669 |
| 2007/0202725 | A1 | 8/2007 | Teicher | |
| 2007/0243726 | A1* | 10/2007 | Trenne | 439/67 |
| 2008/0032562 | A1* | 2/2008 | McHugh et al. | 439/668 |
| 2008/0067248 | A1* | 3/2008 | Hiew et al. | 235/441 |
| 2008/0090465 | A1* | 4/2008 | Matsumoto et al. | 439/669 |
| 2008/0119076 | A1 | 5/2008 | Teicher | |
| 2008/0119291 | A1* | 5/2008 | Takamoto et al. | 463/47 |
| 2008/0167828 | A1 | 7/2008 | Terlizzi et al. | |
| 2008/0200069 | A1* | 8/2008 | Hankey et al. | 439/607 |
| 2008/0274633 | A1 | 11/2008 | Teicher | |
| 2008/0309313 | A1* | 12/2008 | Farrar et al. | 323/351 |
| 2009/0004923 | A1* | 1/2009 | Tang et al. | 439/660 |
| 2009/0011621 | A1 | 1/2009 | Trenne | |
| 2009/0108848 | A1* | 4/2009 | Lundquist et al. | 324/538 |
| 2009/0117768 | A1* | 5/2009 | Liao | 439/300 |
| 2009/0149049 | A1 | 6/2009 | Harkabi et al. | |
| 2009/0156027 | A1* | 6/2009 | Chen | 439/83 |
| 2009/0180243 | A1* | 7/2009 | Lynch et al. | 361/679.01 |
| 2009/0291576 | A1* | 11/2009 | Johansson et al. | 439/152 |
| 2010/0009575 | A1* | 1/2010 | Crooijmans et al. | 439/668 |
| 2010/0062656 | A1* | 3/2010 | Lynch et al. | 439/669 |
| 2010/0080563 | A1* | 4/2010 | DiFonzo et al. | 398/115 |
| 2010/0104126 | A1* | 4/2010 | Greene | 381/384 |
| 2010/0171465 | A1 | 7/2010 | Seal et al. | |
| 2010/0173533 | A1* | 7/2010 | Yang et al. | 439/733.1 |
| 2010/0221936 | A1* | 9/2010 | Zhao et al. | 439/135 |
| 2010/0248544 | A1* | 9/2010 | Xu et al. | 439/607.04 |
| 2010/0254602 | A1* | 10/2010 | Yoshino | 382/167 |
| 2010/0254662 | A1* | 10/2010 | He et al. | 385/75 |
| 2010/0262744 | A1 | 10/2010 | Deva et al. | |
| 2010/0267261 | A1* | 10/2010 | Lin et al. | 439/218 |
| 2010/0267262 | A1* | 10/2010 | Lin et al. | 439/218 |
| 2011/0136381 | A1* | 6/2011 | Cho | 439/620.01 |
| 2011/0159719 | A1* | 6/2011 | Takahashi et al. | 439/329 |
| 2011/0201213 | A1* | 8/2011 | Dabov et al. | 439/39 |
| 2011/0250786 | A1* | 10/2011 | Reid | 439/488 |
| 2011/0263141 | A1* | 10/2011 | Ko | 439/83 |
| 2011/0294354 | A1* | 12/2011 | Chen et al. | 439/660 |
| 2011/0312200 | A1* | 12/2011 | Wang et al. | 439/218 |
| 2012/0028495 | A1* | 2/2012 | Su et al. | 439/449 |
| 2012/0149244 | A1* | 6/2012 | Zheng et al. | 439/658 |
| 2013/0075149 | A1* | 3/2013 | Golko et al. | 174/359 |
| 2013/0078869 | A1* | 3/2013 | Golko et al. | 439/668 |
| 2013/0089291 | A1* | 4/2013 | Jol et al. | 385/77 |
| 2013/0095701 | A1* | 4/2013 | Golko et al. | 439/660 |
| 2013/0095702 | A1* | 4/2013 | Golko et al. | 439/676 |
| 2013/0115821 | A1* | 5/2013 | Golko et al. | 439/638 |
| 2013/0117470 | A1* | 5/2013 | Terlizzi et al. | 710/3 |
| 2013/0122754 | A1 | 5/2013 | Golko et al. | |
| 2013/0149911 | A1 | 6/2013 | Golko et al. | |
| 2013/0217253 | A1 | 8/2013 | Golko et al. | |
| 2013/0244489 | A1 | 9/2013 | Terlizzi et al. | |
| 2013/0244491 | A1* | 9/2013 | Sarwar et al. | 439/655 |
| 2013/0244492 | A1 | 9/2013 | Golko et al. | |
| 2013/0337698 | A1* | 12/2013 | Little et al. | 439/660 |
| 2014/0004741 | A1* | 1/2014 | Jol et al. | 439/620.01 |
| 2014/0057496 | A1* | 2/2014 | Siahaan et al. | 439/660 |
| 2014/0069709 | A1* | 3/2014 | Schmidt et al. | 174/520 |
| 2014/0073170 | A1* | 3/2014 | Golko et al. | 439/350 |
| 2014/0073183 | A1 | 3/2014 | Golko et al. | |
| 2014/0073193 | A1* | 3/2014 | SooHoo et al. | 439/661 |
| 2014/0170907 | A1 | 6/2014 | Golko et al. | |
| 2014/0206209 | A1* | 7/2014 | Kamei et al. | 439/81 |
| 2014/0294656 | A1* | 10/2014 | Brickner et al. | 419/28 |
| 2014/0329416 | A1* | 11/2014 | Golko et al. | 439/676 |
| 2015/0155657 | A1 | 6/2015 | Golko et al. | |

FOREIGN PATENT DOCUMENTS

| | | | |
|---|---|---|---|
| CN | 101116227 | A | 1/2008 |
| CN | 201402871 | Y | 2/2010 |
| CN | 201509210 | U | 6/2010 |
| CN | 101782888 | A | 7/2010 |
| CN | 101783466 | A | 7/2010 |
| CN | 201533091 | U | 7/2010 |
| DE | 19609571 | A1 | 11/1995 |
| DE | 202004021354 | U1 | 9/2007 |
| EP | 0081372 | A2 | 6/1983 |
| EP | 1684391 | A2 | 7/2006 |
| EP | 1717910 | A2 | 11/2006 |
| EP | 2169774 | A1 | 3/2010 |
| EP | 2373131 | A1 | 10/2011 |
| JP | 2078171 | A | 3/1990 |
| JP | H06231821 | A | 8/1994 |
| JP | H06250103 | A | 9/1994 |
| JP | 8321360 | A | 12/1996 |
| JP | 2001223057 | A | 8/2001 |
| JP | 2003217728 | A | 7/2003 |
| JP | 2004079491 | A | 3/2004 |
| JP | 2008041656 | A | 2/2008 |
| JP | 2008508694 | A | 3/2008 |
| JP | 2008210674 | A | 9/2008 |
| JP | 2009117128 | A | 5/2009 |
| JP | 2010067459 | A | 3/2010 |
| KR | 1020110061283 | | 6/2011 |
| TW | M318831 | U | 9/2007 |
| TW | M327102 | U | 2/2008 |
| TW | M350153 | U | 2/2009 |
| TW | 201101601 | * | 1/2011 |
| TW | 201101601 | A | 1/2011 |
| WO | 0208872 | A1 | 1/2002 |
| WO | 2004097995 | A1 | 11/2004 |
| WO | 2005013436 | A1 | 2/2005 |
| WO | 2005124932 | A2 | 12/2005 |
| WO | 2006013553 | A2 | 2/2006 |
| WO | 2006074348 | A1 | 12/2006 |
| WO | 2007090069 | | 8/2007 |
| WO | 2008065659 | A2 | 6/2008 |
| WO | 2009069969 | A2 | 6/2009 |
| WO | 2009140992 | A1 | 11/2009 |
| WO | 2011043488 | A1 | 4/2011 |
| WO | 2011150403 | A1 | 12/2011 |
| WO | 2011163256 | A1 | 12/2011 |
| WO | 2012086145 | A1 | 6/2012 |
| WO | 2013070767 | A1 | 5/2013 |
| WO | 2013082175 | A2 | 6/2013 |

OTHER PUBLICATIONS

Office Action for Russian Application No. 2012157740, mailed Mar. 21, 2014, 5 pages.

Partial Search Report for International PCT Application No. PCT/US2014/012535 (mailed with Invitation to Pay Fees), mailed Apr. 4, 2014, 7 pages.

Non-Final Office Action for U.S. Appl. No. 13/700,441, mailed Apr. 10, 2014, 36 pages.

Office Action for Australian Application No. 2012245184, mailed Apr. 28, 2014, 3 pages.

Office Action for Korean Patent Application No. 10-2012-7034333, mailed Apr. 29, 2014, 6 pages.

Office Action for Taiwanese Patent Application No. 100121725, mailed May 1, 2014, 8 pages.

Office Action, Canadian Patent Application No. 2,800,738, mailed May 8, 2014, 2 pages.

Non-Final Office Action for U.S. Appl. No. 13/703,893, mailed May 9, 2014, 10 pages.

Non-Final Office Action for U.S. Appl. No. 13/704,236, mailed May 19, 2014, 10 pages.

Office Action for Malaysian Patent Application No. PI2012005119, mailed on May 15, 2014, 4 pages.

International Preliminary Report on Patentability for International PCT Application No. PCT/US2012/063944, mailed May 22, 2014, 15 pages.

International Preliminary Report on Patentability for International PCT Application No. PCT/US2012/054318, mailed Jun. 12, 2014, 8 pages.

European Search Report, EP App. No. 13195854.8, mailed Mar. 12, 2014, 7 pages.

International Preliminary Report on Patentability for International PCT Application No. PCT/US2012/066881, mailed Jun. 12, 2014, 14 pages.

(56) References Cited

OTHER PUBLICATIONS

Office Action for Korean Patent Application No. 10-2013-7001302, mailed Jun. 13, 2014, 9 pages.
Non-Final Office Action for U.S. Appl. No. 13/704,234, mailed Jul. 11, 2014, 6 pages.
First Office Action, Australian Patent Application No. 2012101657; Mailed Dec. 14, 2012, 4 pages.
International Preliminary Report on Patentability for International PCT Application No. PCT/US2011/038452, mailed Dec. 13, 2012, 19 pages.
International Preliminary Report on Patentability for International PCT Application No. PCT/US2011/041127, mailed Jan. 3, 2013, 8 pages.
International Preliminary Report on Patentability for International PCT Application No. PCT/US2011/041286, mailed Jan. 10, 2013, 12 pages.
International Preliminary Report on Patentability for International PCT Application No. PCT/US2011/041290, mailed Jan. 10, 2013, 15 pages.
International Search Report and Written Opinion for International PCT Application No. PCT/US2011/041127, mailed on Dec. 29, 2011, 17 pages.
International Search Report and Written Opinion for International PCT Application No. PCT/US2011/041286, mailed on Oct. 20, 2011, 18 pages.
International Search Report and Written Opinion for International PCT Application No. PCT/US2011/041290, mailed on Nov. 21, 2011, 21 pages.
International Search Report and Written Opinion for International PCT Application No. PCT/US2012/063944, mailed Apr. 18, 2013, 23 pages.
Non-Final Office Action for U.S. Appl. No. 13/679,991, mailed Apr. 5, 2013, 19 pages.
Non-Final Office Action for U.S. Appl. No. 13/679,992, mailed Apr. 9, 2013, 18 pages.
Notice of Allowance for U.S. Appl. No. 13/679,992, mailed Jun. 11, 2013, 17 pages.
Notice of Allowance for U.S. Appl. No. 13/679,991, mailed Jul. 10, 2013, 22 pages.
Notice of Allowance for U.S. Appl. No. 13/679,996, mailed Apr. 12, 2013, 30 pages.
Notice of Allowance for U.S. Appl. No. 13/720,822, mailed Apr. 8, 2013, 30 pages.
Partial Search Report for International PCT Application No. PCT/US2012/063944 (mailed with Invitation to Pay Fees), mailed Feb. 20, 2013, 59 pages.
Partial Search Report for International PCT Application No. PCT/US2012/066881 (mailed with Invitation to Pay Fees), mailed Mar. 25, 2013, 8 pages.
Partial Search Report, EP App. No. 12191619.1, Mailed Feb. 20, 2013, 6 pages.
Search and Examination Report for United Kingdom Patent Application No. 1220045.7, mailed on Mar. 15, 2013, 7 pages.
Written Opinion for International PCT Application No. PCT/US2011/038452, mailed on Oct. 26, 2011, 17 pages.
Non-Final Office Action for U.S. Appl. No. 13/607,366, mailed Jul. 11, 2013, 23 pages.
Ex Parte Quayle Office Action for U.S. Appl. No. 13/761,001, mailed Jul. 17, 2013, 10 pages.
International Search Report and Written Opinion for International PCT Application No. PCT/US2013/038008, mailed Aug. 15, 2013, 12 pages.
Notice of Allowance for U.S. Appl. No. 13/761,001 , mailed Sep. 10, 2013, 9 pages.
International Search Report and Written Opinion for International PCT Application No. PCT/US2012/066881, mailed Sep. 9, 2013, 19 pages.
Office Action for Taiwanese Patent Application No. 101145138, mailed Sep. 4, 2014, 23 pages.
Office Action for Chinese Patent Application No. 201310310784.3, mailed Sep. 16, 2014, 12 pages.
Office Action for Chinese Patent Application No. 201210442879.6, mailed Sep. 23, 2014, 21 pages.
Office Action for Chinese Patent Application No. 201180030580.3, mailed Sep. 29, 2014, 29 pages.
Notice of Allowance for U.S. Appl. No. 13/704,234, mailed Sep. 30, 2014, 10 pages.
Office Action for Chinese Patent Application No. 201310743192.0, mailed Oct. 15, 2014, 11 pages.
Notice of Allowance for Chinese Patent Application No. 201310711187.1, mailed Nov. 3, 2014, 4 pages.
International Search Report and Written Opinion for International PCT Application No. PCT/US2014/012535, mailed Nov. 6, 2014, 17 pages.
Notice of Allowance for U.S. Appl. No. 13/703,893, mailed Nov. 7, 2014, 2 pages.
Notice of Allowance for U.S. Appl. No. 13/704,236, mailed Nov. 7, 2014, 2 pages.
Notice of Allowance for U.S. Appl. No. 13/700,441, mailed Nov. 10, 2014, 5 pages.
International Search Report and Written Opinion for International PCT Application No. PCT/US2012/054318, mailed on Oct. 25, 2012, 47 pages.
International Search Report for International PCT Application No. PCT/US2011/038452, mailed on Oct. 26, 2011, 27 pages.
Extended European Search Report, EP App. No. 12191619.1, Mailed Jul. 10, 2013, 13 pages.
International Search Report and Written Opinion for International PCT Application No. PCT/US2013/037233, mailed on Oct. 1, 2013, 14 pages.
Notice of Allowance for U.S. Appl. No. 13/607,366, mailed Oct. 31, 2013, 14 pages.
Office Action and Search Report for Taiwanese Application No. 100118944, mailed Sep. 16, 2013, 24 pages.
Office Action for Australian Application No. 2012245184, mailed Nov. 6, 2013, 3 pages.
Non-Final Office Action for U.S. Appl. No. 13/607,566, mailed Dec. 6, 2013, 20 pages.
Office Action for Australian Application No. 2011257975, mailed Dec. 16, 2013, 6 pages.
Extended European Search Report, EP App. No. 13165892.4, mailed Dec. 20, 2013, 6 pages.
Office Action for Korean Patent Application No. 10-2012-0125751, mailed Jan. 22, 2014, 6 pages.
Office Action for Mexican Patent Application No. MX/a/2012/013857, mailed Feb. 6, 2014, 3 pages.
Office Action, Canadian Patent Application No. 2,794,906; Mailed Mar. 4, 2014, 2 pages.
Notice of Allowance for U.S. Appl. No. 13/607,566, mailed Mar. 11, 2014, 8 pages.
Extended European Search Report, EP App. No. 14152776.2, mailed Mar. 11, 2014, 9 pages.
Office Action for United Kingdom Application No. 1400243.0, mailed Mar. 12, 2014, 4 pages.
Office Action for Australian Application No. 2013204685, mailed Jul. 17, 2014, 2 pages.
Office Action for Korean Patent Application No. 10-2014-0048365, mailed Aug. 11, 2014, 4 pages.
Office Action for Australian Patent Application No. 2013205161, mailed Aug. 18, 2014, 4 pages.
Office Action for Chinese Patent Application No. 201180030576.7, mailed Sep. 2, 2014, 23 pages.
Non-Final Office Action for U.S. Appl. No. 13/610,631, mailed Sep. 16, 2014, 28 pages.
Notice of Allowance for U.S. Appl. No. 13/703,893, mailed Sep. 16, 2014, 8 pages.
Notice of Allowance for U.S. Appl. No. 13/704,236, mailed Sep. 17, 2014, 9 pages.
Flipper Press Release (Jun. 25, 2012) and Data Sheet: http://www.flipperusb.com/images/flipperUSB-brochure.pdf.

(56) References Cited

OTHER PUBLICATIONS

International Search Report and Written Opinion for International PCT Application No. PCT/CN2012/081257, mailed on Jun. 20, 2013, 11 pages.
Office Action for Chinese Patent Application No. 201310711187.1, mailed Jul. 14, 2014, 5 pages.
Office Action for Mexican Patent Application No. MX/a/2012/013857, mailed Jul. 23, 2014, 4 pages.
Final Office Action for U.S. Appl. No. 13/700,441, mailed Aug. 21, 2014, 9 pages.
Hewlett-Packard Company, "An Overview of Current Display Interfaces," Nov. 2007, p. 12, http://isvpatch.external.hp.com/HPPTF2/drvlib/docs/DisplayInterfacesOverview.pdf, 14 pages.
Office Action for Korean Patent Application No. 10-2012-7034333, mailed Nov. 18, 2014, 4 pages.
Non-Final Office Action for U.S. Appl. No. 13/607,430, mailed Nov. 26, 2014, 20 pages.
Extended European Search Report, EP App. No. 13165270.3, Mailed Nov. 28, 2014, 12 pages.
Office Action, Canadian Patent Application No. 2,800,738, mailed Dec. 2, 2014, 3 pages.
Non-Final Office Action for U.S. Appl. No. 14/137,824, mailed Dec. 17, 2014, 6 pages.
Non-Final Office Action for U.S. Appl. No. 13/875,637, mailed Dec. 26, 2014, 11 pages.
Notice of Allowance for U.S. Appl. No. 13/610,631, mailed Mar. 17, 2015, 9 pages.
International Preliminary Report on Patentability for International PCT Application No. PCT/CN2012/081257, mailed Feb. 5, 2015, 18 pages.
Notice of Allowance for U.S. Appl. No. 13/875,637, mailed Feb. 11, 2015, 7 pages.
Office Action for Chinese Patent Application No. 201180034957.2, mailed Dec. 22, 2014, 22 pages.
Office Action for Japanese Patent Application No. 2013-512061, mailed Dec. 24, 2014, 4 pages.
Non-Final Office Action for U.S. Appl. No. 13/610,777, mailed Jan. 26, 2015, 7 pages.

* cited by examiner

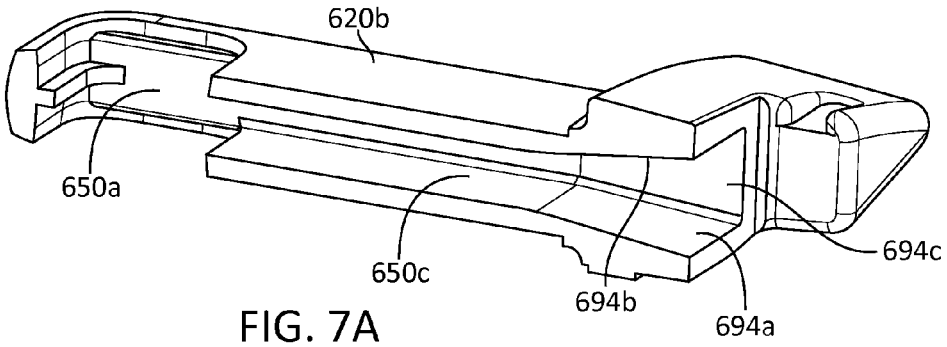
FIG. 7A
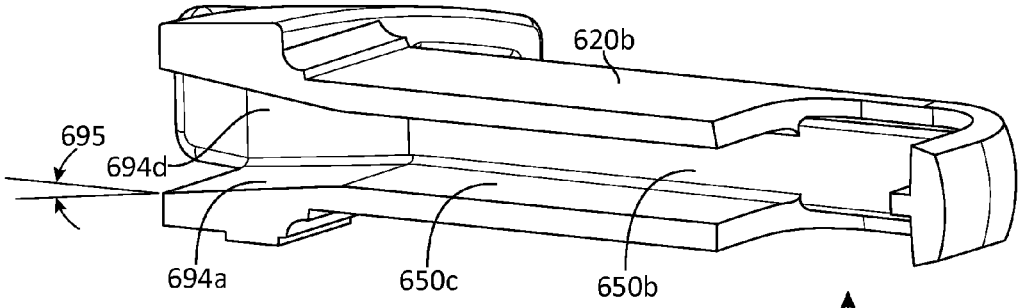
FIG. 7B
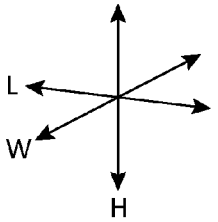

CONNECTORS AND METHODS FOR MANUFACTURING CONNECTORS

CROSS-REFERENCES TO RELATED APPLICATIONS

The present application is a continuation-in-part of U.S. application Ser. No. 13/610,631 filed Sep. 11, 2012, entitled "Connectors and Methods for Manufacturing Connectors," the disclosure of which is incorporated by reference herein in its entirety.

BACKGROUND OF THE INVENTION

The present invention relates generally to electronic connectors such as audio and data connectors, and in particular ground rings or frames for plug connectors.

Many electronic devices mate with electrical connectors that receive and provide power and data. For example, devices, such as tablets, laptops, netbooks, desktops, and all-in-one computers; cell, smart, and media phones; storage devices, portable media players, navigation systems, monitors, and others, use electrical connectors for power and/or data.

These electrical connectors are often plug connectors that are designed to mate with corresponding receptacle connectors on an electronic device. Many previously known plug connectors, such as USB connectors, include a plurality of contacts that are surrounded by a metal shell. The metal shell creates a cavity in which debris may collect and adds to the thickness of the connector. As electronic devices continue to become smaller, there is an increasing demand for smaller plug connectors and corresponding receptacle connectors.

BRIEF SUMMARY OF THE INVENTION

Various embodiments of the invention pertain to a frame (sometimes referred to as a ground ring) that can be used in a plug connector to provide support for a plurality of external contacts on one or more sides of the frame. For example, a plug connector capable being of a reduced size may include a frame having features to support external contacts, house circuitry for coupling with the contacts, facilitate the flow of molten material during the molding of the frame, and allow for ease of insertion and removal of the plug connector to and from a corresponding receptacle connector.

Embodiments of the present invention may also provide methods for easily manufacturing the plug connector frames described herein. For example, methods are provided for metal injection molding processes for forming a plug connector frame that includes some or all of the features described above. Some of these methods may result in a plug connector frame having distinctive physical characteristics, including an outer layer with increased density, surface hardness and/or reduced porosity as compared to a remainder of the plug connector frame. Further examples include using metal working processes such as machining, stamping, forging, and cold heading as well as die casting, injection molding and combinations thereof to manufacture grounds rings or plug connector frames.

According to one embodiment, a method of manufacturing a metal frame for an electrical plug connector is provided. A first metalworking process can be used to form an insertion end. The insertion end can include: (i) a width, height and length dimension; and (ii) first and second opposing sides extending in the width and length dimensions, the first side including a first opening and the second side including a second opening registered with and opposite the first opening, and including third and fourth opposing sides extending between the first and second sides in the height and length dimensions. A second metalworking process can be used to form a flanged end. The flanged end can include: (i) a width, height and length dimension; and (ii) a third opening that communicates with a cavity that extends in the length, width and height dimensions from the flanged end into the insertion end past the first and second openings when the flanged end is assembled with the insertion end. Thereafter, the flanged end can be assembled with the insertion end.

According to another embodiment, a method of manufacturing a frame for an electrical plug connector is provided. A first metalworking process and an insert molding process can be used to form an insertion end. The insertion end can include: (i) a width, height and length dimension; and (ii) first and second opposing sides extending in the width and length dimensions, the first side including a first opening and the second side including a second opening registered with and opposite the first opening, and including third and fourth opposing sides extending between the first and second sides in the height and length dimensions. A second metalworking process can be used to form a flanged end. The flanged end can include: (i) a width, height and length dimension; and (ii) a third opening that communicates with a cavity that extends in the length, width and height dimensions from the flanged end into the insertion end past the first and second openings when the flanged end is assembled with the insertion end. Thereafter, the flanged end can be assembled with the insertion end.

According to yet another embodiment, a method of manufacturing a frame for an electrical plug connector is provided. A wire bending process can be used to form a first portion of an insertion end. The first portion of the insertion end can include: (i) a width, height and length dimension; and (ii) first and second opposing sides extending in the height and length dimensions. A metalworking process can be used to form a flanged end. The flanged end can include: (i) a width, height and length dimension; and (ii) a first opening that communicates with a cavity that extends in the length, width and height dimensions from the flanged end into the insertion end when the flanged end is assembled with the insertion end and after a second portion of the insertion end is formed. Thereafter, the first portion of the insertion end can be assembled with the flanged end. Thereafter, an injection molding process can be used to form the second portion of the insertion end. The second portion of the insertion end can include third and fourth opposing sides extending between the first and second sides in the width and length dimensions, the third side including a second opening and the fourth side including a third opening registered with and opposite the second opening.

According to still another embodiment, a method of manufacturing a metal frame for an electrical plug connector is provided. A sheet metal forming process can be used to form the metal frame. The metal frame can include: (i) a width, height and length dimension; (ii) an insertion end including first and second opposing sides extending in the width and length dimensions and including third and fourth opposing sides extending between the first and second sides in the height and length dimensions; and (iii) a flanged end including a third opening that communicates with a cavity that extends in the length, width and height dimensions from the flanged end into the insertion end. Thereafter, laser cutting, machining or stamping can be used to form a first opening in the first side and a second opening in the second side, the first opening being registered with the second opening.

According to yet another embodiment, a method of manufacturing an electrical plug connector is provided. An injection molding process can be used to form the plug connector. The plug connector can include: (i) a width, height and length dimension; (ii) an insertion end including first and second opposing sides extending in the width and length dimensions, the first side including a first set of contacts and the second side including a second set of contacts opposite the first set of contacts, and including third and fourth opposing sides extending between the first and second sides in the height and length dimensions; and (iii) a flanged end.

According to yet another embodiment, a method of manufacturing a frame for an electrical plug connector is provided. Zinc die casting can be used to form the frame. The frame can include: (i) a width, height and length dimension; (ii) an insertion end including first and second opposing sides extending in the width and length dimensions, the first side including a first opening and the second side including a second opening registered with and opposite the first opening, and including third and fourth opposing sides extending between the first and second sides in the height and length dimensions; and (iii) a flanged end including a third opening that communicates with a cavity that extends in the length, width and height dimensions from the flanged end into the insertion end past the first and second openings.

Although aspects of the invention are described in relation to a ground ring or plug connector frame for a particular plug connector, it is appreciated that these features, aspects and methods can be used in a variety of different environments, regardless of the corresponding plug connector size or type.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

BRIEF DESCRIPTION OF THE DRAWINGS

FIGS. 7A and 7B are cross sectional perspective views of two opposing portions of the frame of FIGS. 6A-6F.

DETAILED DESCRIPTION OF THE INVENTION

Figure 1B:
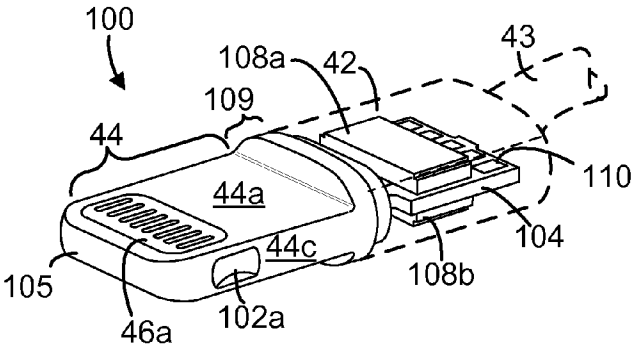
FIGS. 1B-1D depict an eight contact in-line dual orientation plug connector that may include a ground ring or frame according to embodiments of the present invention.

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

As discussed earlier, the invention may apply to a variety of plug connectors which use a variety of different connector technologies. Accordingly, this invention may be used with many electronic devices that mate with a variety of electrical connectors in order to receive and provide power and data. Examples of electronic devices that may be used with embodiments of the present invention are shown in the following figure.

I. Electronic Devices for Use with the Invention

FIG. 1 depicts an illustrative rendering of one particular electronic media device 10. Device 10 includes a multipurpose button 15 as an input component, a touch screen display 20 as a both an input and output component, and a speaker 25 as an output component, all of which are housed within a device housing 30. Device 10 also includes a primary receptacle connector 35 and an audio plug receptacle 40 within device housing 30. Each of the receptacle connectors 35 and 40 can be positioned within housing 30 such that the cavity of the receptacle connectors into which a corresponding plug connector is inserted is located at an exterior surface of the device housing. In some embodiments, the cavity opens to an exterior side surface of device 10. For simplicity, various internal components, such as the control circuitry, graphics circuitry, bus, memory, storage device and other components are not shown in FIG. 1. Embodiments of the invention disclosed herein are particularly suitable for use with plug connectors that are configured to mate with primary receptacle connector 35, but in some embodiments can also be used with audio plug receptacle 40. Additionally, in some embodiments, electronic media device 10 has only a single receptacle connector 35 that is used to physically interface and connect the device (as opposed to a wireless connection which can also be used) to the other electronic devices.

Although device 10 is described as one particular electronic media device, embodiments of the invention are suitable for use with a multiplicity of electronic devices that include a receptacle connector that corresponds to a plug connector including a frame. For example, any device that receives or transmits audio, video or data signals among may be used with the invention. In some instances, embodiments of the invention are particularly well suited for use with portable electronic media devices because of their potentially small form factor. As used herein, an electronic media device includes any device with at least one electronic component that may be used to present human-perceivable media. Such devices may include, for example, portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, desktop computers, as well as tablet (e.g., Apple's iPad devices), laptop or other mobile computers. Some of these devices may be configured to provide audio, video or other data or sensory output.

In order to better appreciate the features and aspects of ground rings or frames of the present invention, further context for the invention is provided in the following section by discussing a one particular plug connector in which the invention may be implemented.

II. Plug Connectors that May Include the Invention

Figure 1D:
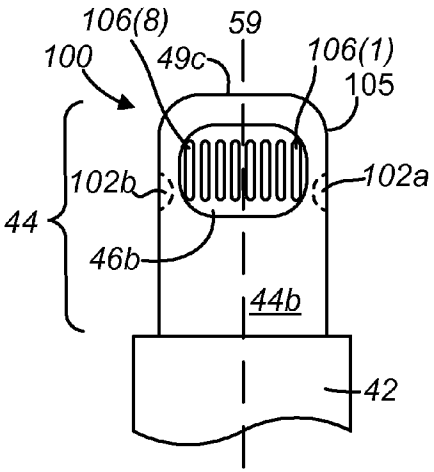
Figure 1C:
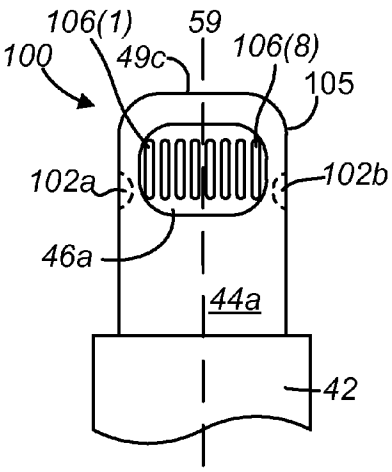
Figure 1A:
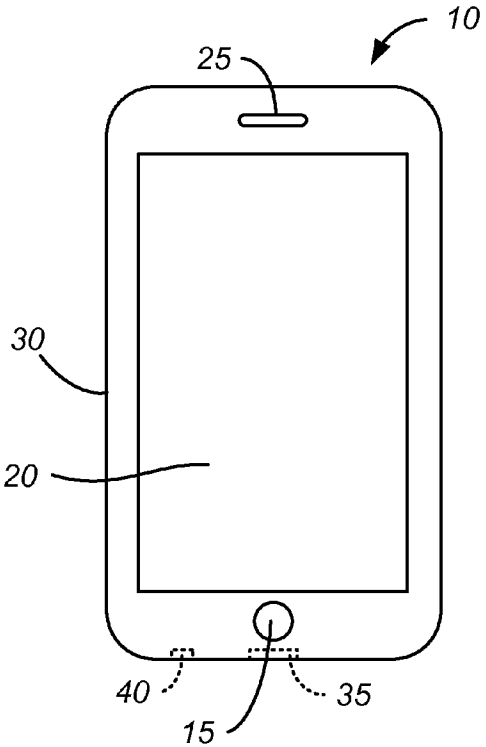
FIG. 1A illustrates a rendering of one particular electronic media device.

FIGS. 1B-1D depict an eight contact in-line dual orientation plug connector 100 that may include a ground ring or frame according to embodiments of the present invention. FIG. 1B is a simplified perspective view of plug connector 100 and FIGS. 1C and 1D are simplified top and bottom plan views, respectfully, of plug connector 100. As shown in FIG. 1B, plug connector 100 includes a body 42 and a tab or insertion end 44 that extends longitudinally away from body 42 in a direction parallel to the length of the connector. A cable 43 is attached to body 42 at an end opposite of Insertion end 44.

Insertion end 44 is sized to be inserted into a corresponding receptacle connector, such as connector 35, during a mating event and includes a first contact region 46*a* formed on a first major surface 44*a* and a second contact region 46*b* (not shown in FIG. 1B) formed at a second major surface 44*b* opposite surface 44*a*. Surfaces 44*a*, 44*b* extend from a distal tip or end of the insertion end to a flanged end 109. When insertion end 44 is inserted into a corresponding receptacle connector, surfaces 44*a*, 44*b* abut a housing of the receptacle connector or host device the receptacle connector is incorporated in. Insertion end 44 also includes first and second opposing side surfaces 44*c*, 44*d* that extend between the first and second major surfaces 44*a*, 44*b*. In some embodiments, insertion end 44 is between 4 and 7 mm wide, between 1 and 2 mm thick and has an insertion depth (the distance from the distal tip of insertion end 44 to flanged end 109) between 5 and 10 mm.

The structure and shape of insertion end 44 and flanged end 109 are defined by a ground ring or frame 105 that can be made from stainless steel or another conductive material. Plug connector 100 includes retention features 102*a*, 102*b* formed as curved recesses in the sides of ground ring 105. Body 42 is shown in FIG. 1B in transparent form (via dotted lines) so that certain components inside the body are visible. As shown, within body 42 is a printed circuit board (PCB) 104 that extends into ground ring 105 between contact regions 46*a* and 46*b* towards the distal tip of plug connector 100. One or more integrated circuits (ICs), such as Application Specific Integrated Circuit (ASIC) chips 108*a* and 108*b*, can be operatively coupled to PCB 104 to provide information regarding plug connector 100 and any accessory or device that plug connector 100 is part of and/or to perform specific functions, such as authentication, identification, contact configuration and current or power regulation.

Bonding pads 110 can also be formed within body 42 near the end of PCB 104. Each bonding pad can be connected to a contact or contact pair within regions 46*a* and 46*b*. Wires (not shown) within cable 43 can then be soldered to the bonding pads to provide an electrical connection from the contacts to the accessory or device that plug connector 100 is associated with. Generally, there is one bonding pad and one wire within cable 43 for each set of electrically independent contacts (e.g., a pair of electrically connected contacts, one in region 46*a* and one in region 46*b*) of plug connector 100. Additionally, one or more ground wires (not shown) from cable 43 can also be soldered or otherwise connected to frame 105 for a ground signal.

As shown in FIGS. 1C and 1D, eight external contacts 106(1) . . . 106(8) are spaced apart along a single row in each of contact regions 46*a*, 46*b*. Each contact in contact region 46*a* is electrically connected to a corresponding contact in contact region 46*b* on the opposite side of the connector. Contacts 106(1) . . . 106(8) can be used to carry a wide variety of signals including digital signals and analog signals as well as power and ground as previously discussed.

In one embodiment, plug connector 100 can be the plug connector portion of a plug connector/receptacle connector pair that can be the primary physical connector system for an ecosystem of products that includes both host electronic devices and accessory devices. Examples of host devices include smart phones, portable media players, tablet computers, laptop computers, desktop computers and other computing devices. An accessory can be any piece of hardware that connects to and communicates with or otherwise expands the functionality of the host. Many different types of accessory devices can be specifically designed or adapted to communicate with the host device through plug connector 100 to provide additional functionality for the host. Plug connector 100 can be incorporated into each accessory device that is part of the ecosystem to enable the host and accessory to communicate with each other over a physical/electrical channel when plug connector 100 from the accessory is mated with a corresponding receptacle connector in the host device. Examples of accessory devices include docking stations, charge/sync cables and devices, cable adapters, clock radios, game controllers, audio equipment, memory card readers, headsets, video equipment and adapters, keyboards, medical sensors such as heart rate monitors and blood pressure monitors, point of sale (POS) terminals, as well as numerous other hardware devices that can connect to and exchange data with the host device.

An example of how the elements of plug connector 100 are manufactured and assembled together is shown in the following figures.

FIGS. 2A-2F depict plug connector 100 at the various stages of manufacture. The manufacture of plug connector 100 can start with the fabrication of ground ring or frame 105, the construction of printed circuit board 104 and the construction of contact assemblies 116*a*, 116*b* each of which may occur independent of the others in any order. Frame 105 (FIG. 2A) may be fabricated using a variety of techniques, which will be discussed in detail below.

Printed circuit board 104 (FIG. 2B) can be formed with a set of bonding pads 110 formed at one end and a second set of bonding pads 112 formed at the opposing end. Bonding pads 110 can serve as a solder attachment point for wires from cable 43 as discussed above and can be formed on one or both sides of PCB 104 as needed for connections. Eight bonding pads 112 corresponding to the eight contacts 106(1) . . . (8) are formed on each of the opposing sides 104*a*, 104*b* of PCB 104. Additionally, a third set of bonding pads 114 can be formed on either or both sides of PCB 104 to electrically connector one or more integrated circuits, such as ICs 108*a*, 108*b*, to the printed circuit board using a flip-chip or other appropriate connection method.

After ICs 108*a*, 108*b* are attached to the printed circuit board, PCB 104 is inserted through a back opening of frame 105 so that bonding pads 112 are positioned within opening 106. Next, contact assemblies 116*a*, 116*b* (FIG. 2D) are positioned within the openings 106 on each side of frame 105. Each contact assembly includes a frame 115 (FIG. 2D) that can be formed from a dielectric material such as polypropylene, and includes eight slots—one for each of contacts 106 (1) . . . (8). The contacts can be made from a variety of conductive materials and as examples, can be nickel-plated brass, stainless steel or palladium nickel. The contacts can be cut to size in a stamping or similar process from a metal sheet and placed in respective slots of each frame 115.

Figure 2A:
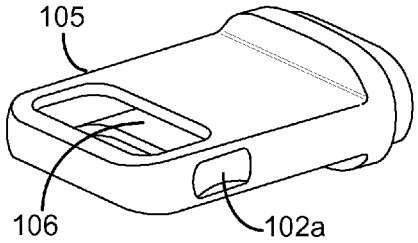
FIGS. 2A-2F depict plug connector 100 at the various stages of manufacture.
Figure 2B:
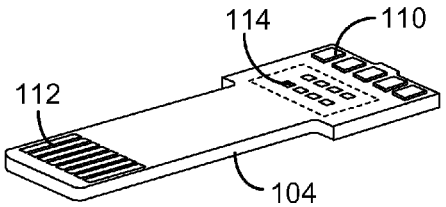
Figure 2C:
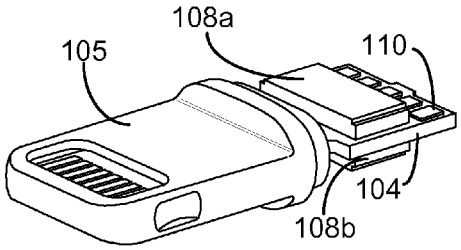
Figure 2D:
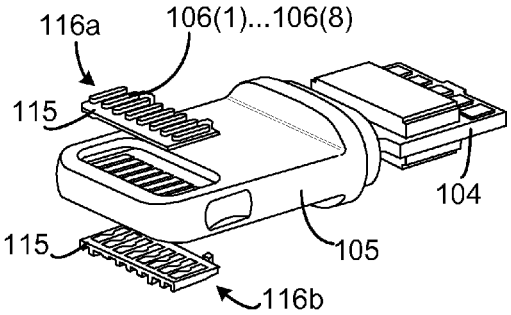
Figure 2E:
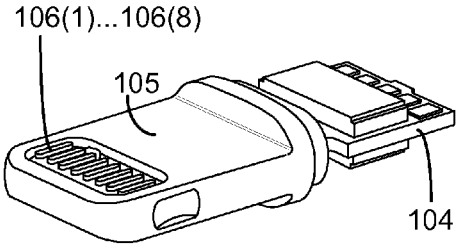
Figure 2F:
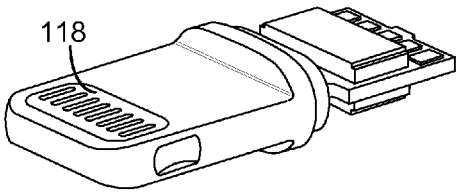

The assembled ground ring/PCB/contact assembly structure (FIG. 2E) is then placed in a molding tool and a thermoplastic or similar dielectric overmold 118 can be formed around the contacts to provide smooth and substantially flat upper and lower surfaces of the tab or insertion end of plug connector 100 and provide a finished look (FIG. 2F). In one embodiment, dielectric overmold 118 is formed with an injection molding process using polyoxymethylene (POM).

A cable bundle (e.g., cable 43 shown in FIG. 1B) having individual signal wires (not shown), one for each of the functional contacts of plug connector 100 as well as one or more ground wires can be coupled to frame 105. The individual signal wires are cut and stripped, the jacket of the cable bundle is stripped and the cable shields are folded back over the jacket. The cable bundle can then be attached to the frame/PCB assembly by soldering each of the signal wires to its respective bonding pad 110 and soldering ground wires to frame 105. The solder joints and exposed wires can be potted with a UV glue to further secure the connections.

At this stage of manufacture the end of cable bundle (e.g., cable 43 shown in FIG. 1B) is attached to the PCB assembly via the soldered wires and a dielectric strain relief jacket (not shown) can be formed around the attachment point between cable 43 and PCB 104 encasing the portion of PCB 104 that extends out of frame 105 including ICs 108*a*, 108*b*. The strain relief jacket can be formed using an injection molding or similar process. The construction of plug connector 100 can then be completed by sliding an outer enclosure around the strain relief jacket. The outer enclosure butts up against and is even with flanged end 109 of frame 105 forming body 42 of plug connector 100. The outer enclosure can be formed from ABS or a similar dielectric material and adhered to the ground ring and inner jacket using any appropriate adhesive suitable for the particular materials being bonded.

As discussed above, although frame 105 is described in relation to one particular plug connector (plug connector 100), embodiments of the invention are suitable for a multiplicity of plug connectors that correspond to receptacle connectors for electronic devices, e.g., devices discussed above.

Frame 105 may include a number of features to accommodate the elements of plug connector 100 described above. In addition, embodiments of the present invention may include features to aid in manufacturing connectors and/or insertion and removal of a connector from a corresponding receptacle connector. Examples of these features are shown in the following figures.

III. Ground Ring Features

Figure 3A:
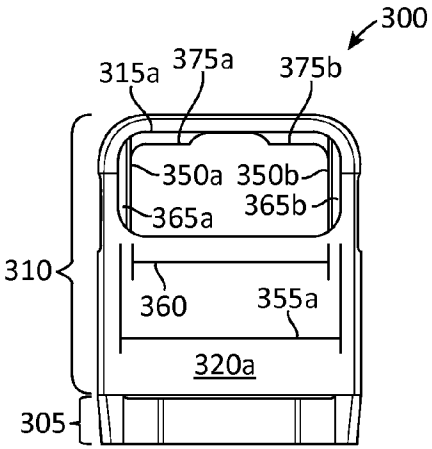
FIGS. 3A-3F illustrate an ground ring or frame according to an embodiment of the present invention.
Figure 3B:
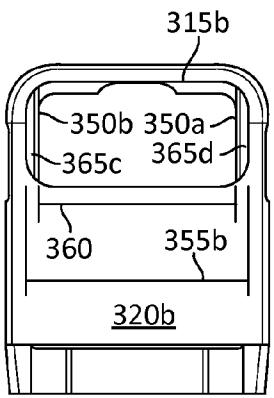
Figure 3C:
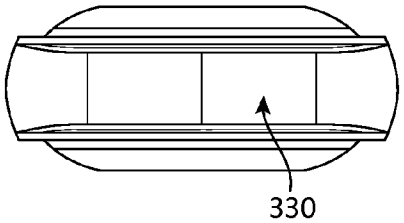
Figure 3E:
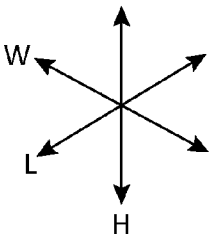
Figure 3E:
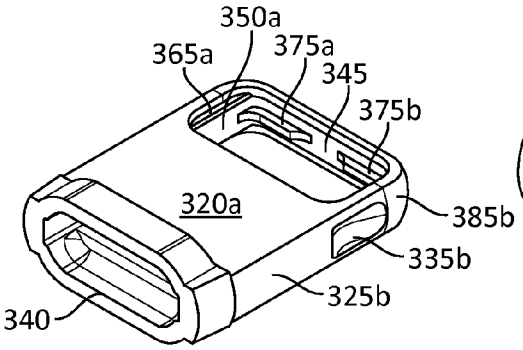
Figure 3F:
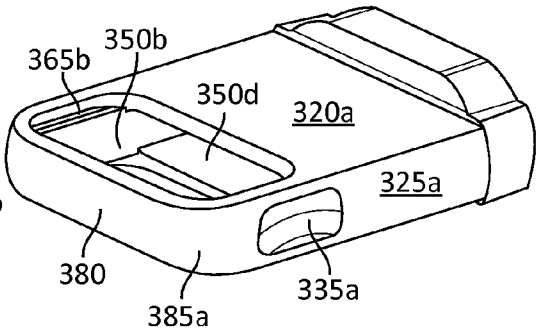
Figure 3D:
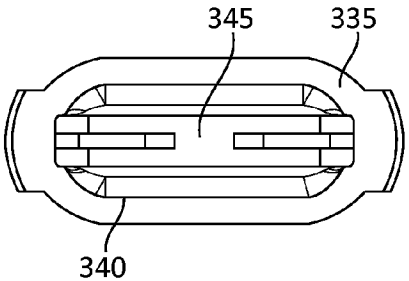

FIGS. 3A-3F illustrate an ground ring or frame 300 according to an embodiment of the present invention. FIGS. 3A-3D are top, bottom, front and back views, respectively, of ground ring or frame 300 according to an embodiment of the present invention. FIGS. 3E and 3F are perspective views of frame 300. Frame 300 may include a flanged end 305 and an insertion end 310 that extending longitudinally away from flanged end 305 in a direction parallel to the length dimension of frame 300.

Insertion end 310 may be sized to be inserted into a corresponding receptacle connector during a mating invention and includes first and second openings 315*a*, 315*b* on first and second opposing major surfaces 320*a*, 320*b*, respectively. In one embodiment, openings 315*a*, 315*b* are identically sized and shaped and directly opposite each other such that insertion end 310 may be a 180 degree symmetrical part. As shown in FIGS. 3A-3B, openings 315*a*, 315*b* may be rectangular with rounded corners. In other embodiments, opening 315*a*, 315*b* may be otherwise shaped, e.g., the opening may be triangular, circular or irregularly shaped. Insertion end 310 also includes first and opposing side surfaces 325*a*, 325*b*. Surfaces 320*a*, 320*b*, 325*a* and 352*b* extend from a distal tip or end 330 of insertion end 310 to flanged end 305. When insertion end 310 is inserted into a corresponding receptacle connector, surfaces 320*a*, 320*b*, 325*a*, and 325*b* may abut inner walls of a housing of a corresponding receptacle connector of a host device. In one particular embodiment, insertion end 310 is 6.6 mm wide in the width dimension, 1.5 mm thick in the height dimension and has an insertion depth (the distance from distal end 330 of insertion end 310 to flanged end 305) in the length dimension of 7.1 mm.

Frame 300 may include retention features 335*a*, 335*b* that are formed as curved recesses on surfaces 325*a*, 325*b*, respectively, proximate distal end 330. These retention features may engage with corresponding retention features disposed in a receptacle connector of a host device and aid in holding a plug connector that includes frame 300 within the receptacle connector. A flanged end surface 335 of flanged end 305 includes an opening 340 that communicates with a cavity that extends in the length, width and height dimensions. The cavity may be defined in part by inner left and right surfaces 350*a*, 350*b* and inner top and bottom surfaces 350*c*, 350*d*. Opening 340 may be sized to receive a PCB (e.g., PCB 104 shown in FIG. 2B) that extends towards an inner end surface 345 proximate distal end 330 and between openings 315*a*, 315*b*.

As shown in FIGS. 3A and 3B, the widths 355*a*, 355*b* of openings 315*a*, 315*b*, respectively, may be greater than the distance 360 between surfaces 350*a*, 350*b* thereby forming ledges 365*a*, 365*b* and 365*c* (shown in FIGS. 4A and 4B), 365*d*, respectively. Ledges 365*a* and 365*d* may be defined by a first ridge (ridge 370*a* shown in FIG. 4A) and ledges 365*b* and 365*c* may be defined by a second ridge (ridge 370*b* shown in FIG. 4B). These ledges may be used to support contacts assemblies (e.g., contacts assemblies 116*a*, 116*b* shown in FIG. 2D) that are assembled with frame 300. In some embodiments, ledges of frame 300 may define additional ridges for supporting contact assemblies. As discussed with regards to plug connector 100, a thermoplastic may be formed around contacts assembled with frame 305, e.g., by overmolding, such that the contacts assemblies are held in place relative to positioning ledges 365*a*-365*d*.

Also shown in FIGS. 3A-3F are interlocks 375*a*, 375*b*, which may further define the cavity of frame 300. Interlocks 375*a*, 375*b* may be disposed on inner end surface 345, protrude toward the third opening and have a thickness in the height dimension. Interlocks 375*a*, 375*b* may assist in preventing material overmolded around contacts assemblies assembled with frame 305 from dislodging and moving in the height dimension. Accordingly, interlocks may prevent displacement of the overmolded contact assemblies when forces are applied to the contacts assemblies in the direction of the height dimension. These forces may be caused by users pressing down on the contact assemblies or otherwise subjecting the contact assemblies to forces, e.g., dropping or hitting the contact assemblies of the plug connector.

Frame 300 also includes an outer end surface 380 that extend between surfaces 325*a*, 325*b*. As shown in FIGS. 3E and 3F, outer end surface 350 may be connected to surfaces 325*a* and 325*b* by rounded portions 355*a* and 355*b*, respectively. Rounded portions 355*a*, 335*b* may serve to help guide a plug connector including frame 305 into a corresponding receptacle connector. For example, where a plug connector including frame 305 is moved towards a receptacle connector sized to receive the plug connector in a direction that is not aligned with the opening of the receptacle connector, rounded portions 335*a*, 335*b* may allow for a greater margin of error in aligning the plug connector for insertion into the opening of the receptacle connector. That is, rounded portions 335*a*, 335*b* of the plug connector may render the profile of frame 105 at distal end 300 smaller relative to the opening of the receptacle connector and thus easier to insert into the opening. Once frame 105 enters the cavity of the receptacle connector, rounded portion 335*a*, 335*b* may also guide the remainder of frame 105 as the rounded portions 335*a*, 335*b* interface with interior walls of the receptacle connector and cause the plug connector including frame 105 to become aligned with the opening of the receptacle connector.

Figure 4B:
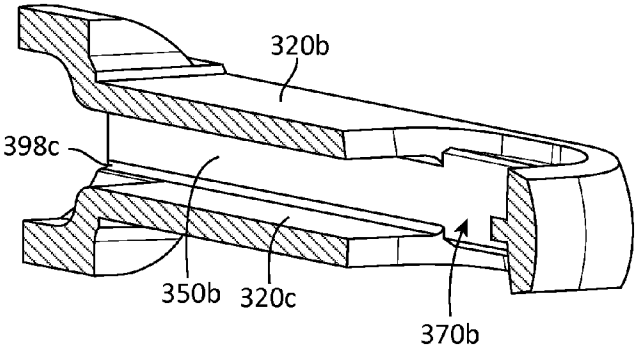
FIGS. 4A-4D are cross sectional views that further illustrate the frame of FIGS. 3A-3F.
Figure 4D:
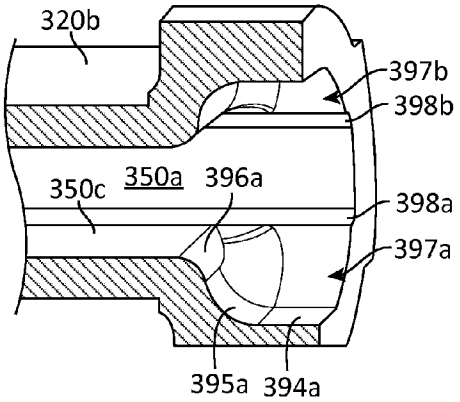
Figure 4A:
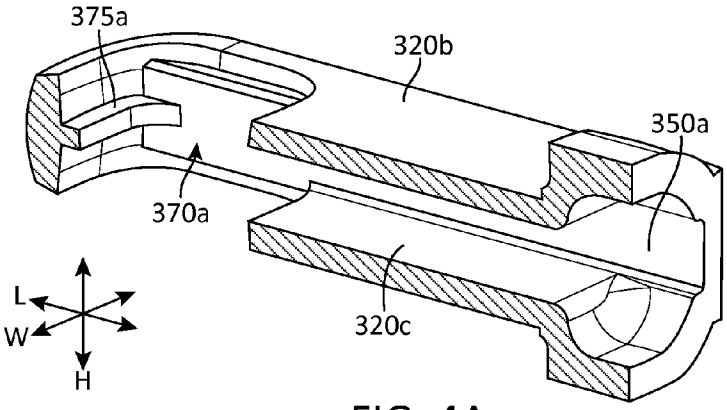
Figure 4C:
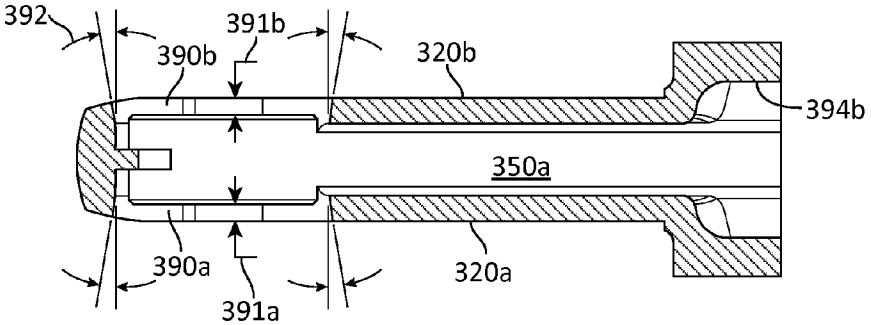

FIGS. 4A-4D are cross sectional views that further illustrate frame 300. FIGS. 4A and 4B are cross sectional perspective views of two opposing portions of frame 300. FIGS. 4C and 4D are also cross section views and provide side and partial perspective cross sectional views of frame 300. FIGS. 4A and 4B illustrate a portion of the cavity of frame 300 as well as including inner surface 350*c*, which was not visible in FIGS. 3A-3F. FIGS. 4A and 4B also show that first and second opening 315*a* and 315*b* may include tapered sidewalls 390*a* and 390*b*, respectively. Sidewalls 390*a* and 390*b* may extent into the cavity at a distance 391*a* and 391*b*, respectively. Tapered sidewalls 390*a*, 390*b* are drafted at draft angle 392. For example, draft angle 392 of tapered sidewalls 390*a*, 390*b* may be between 0 and 20 degrees or 5 and 20 degrees. In other embodiments, sidewalls 390*a*, 390*b* may be drafted at different angles, e.g., one may be drafted a 5 degrees and the other at 10 degrees. These tapered opening 315*a*, 315*b* may more readily receive and align contact assemblies, e.g., contacts assemblies 116*a*, 116*b*.

As shown in FIGS. 4C and 4D, the inner surfaces connecting insertion end 310 and flanged end 305 may include complex geometry. This may be due in part to the process by which frames according to the present invention may be formed. As discussed in greater detail below, frame 300 may be formed through a metal injection molding process wherein the molten material is injected into a mold through a portion of the mold corresponding to flanged end 305 of frame 300. As such, this complex geometry may be designed to eliminate sharp corners near the flanged end 305 in order to optimize the flow of material injected into a mold in order to form frame 300.

For example, flat inner surfaces 350*c* and a flat portion 394*a* of flanged end 305 may be connected by rounded portions 395*a* and 396*a*. Flat inner surface 350*d* may also be connected to flat portion 394*b* by similar rounded portions (not clearly show in FIG. 4C-4D). Additionally, inner surface 350*a* may be connected to inner surfaces 350*c*, 350*d* by rounded portion 398*a* and 398*b*, respectively. Similarly, inner surface 350*b* may be connected to inner surfaces 350*c*, 350*d* by rounded portions (only one rounded portion 398*c* is shown in FIG. 4A-4D). Rounded sections 397*a* may connected flat portion 394*a* to rounded portion 398*a* and rounded sections 397*b* may connect flat portion 394*b* to rounded portion 398*b*. Similar rounded portions may connect flat portions 394*a*, 394*b* to rounded portions connecting surface 350*b* and surfaces 350*c*, 350*d*, respectively (e.g., rounded portion 398*a*).

Although flanged end 305 is shown in FIGS. 3A-3F and 4A-4D as having a particular geometry, other embodiments of the present invention may include a flanged end on a plug connector frame having other geometries. For example, a flanged end having a wider geometry is discussed below. A variety of otherwise shaped flanged ends may also be suitable for the present invention as flanged end 305 may not be intended to be inserted into a receptacle connector such that it would have to conform to any particular geometry of the corresponding receptacle connector.

In addition to those features described above in relation to FIGS. 3A-3F and 4A-4D, frames according to the present invention may include other features instead of or in addition to those features previously described herein. Examples of these additional features are shown in the following figures.

Figure 5A:
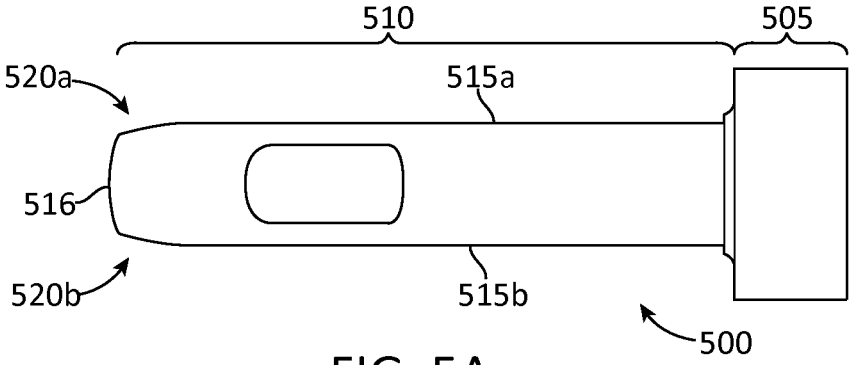
FIGS. 5A-5C illustrate side views of ground rings or frames according to embodiments of the present invention.
Figure 5B:
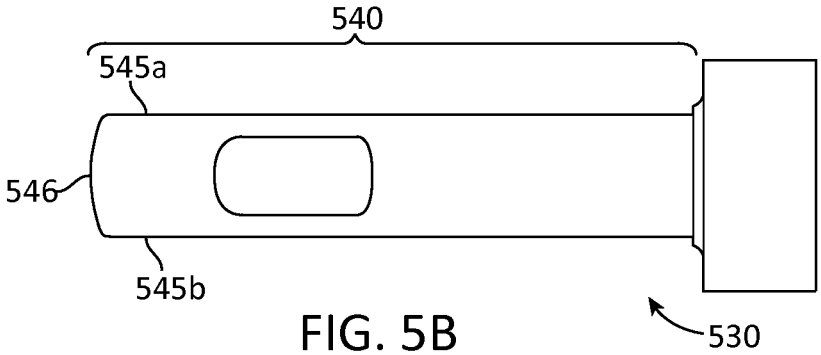
Figure 5C:
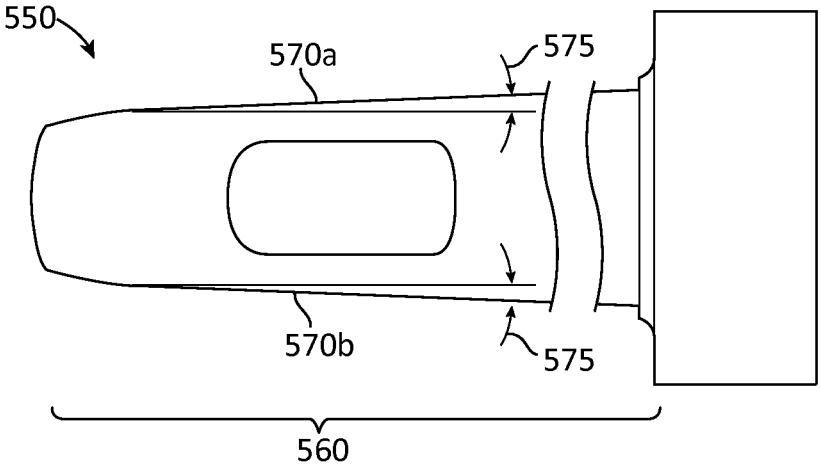

FIGS. 5A-5C illustrate side views of ground rings or frames according to embodiments of the present invention. As shown in FIG. 5A, a frame 500 may include a flanged end 505 and an insertion end 510 that extends longitudinally away from flanged end 505 in a direction parallel to the length dimension of frame 500. Insertion end 510 may include first and second opposing major surfaces 515*a*, 515*b*, respectively. Surfaces 515*a*, 515*b* may include curved lead-ins 520*a*, 520*b* proximate the distal end of frame 500. Curved lead-ins 520*a*, 520*b* may connect an outer end surface 516 with first and second opposing surfaces 515*a*, 515*b*, respectively. The curved lean-in feature may render the plug connector in which frame 500 is implemented more readily insertable into a corresponding receptacle connector. In some embodiments, frame 500 may only include curved lead-in 520*a* while others may only include curved lead-in 520*b*.

FIG. 5B illustrates an embodiment of a frame 530 that does not include the curved lead-in feature of frame 500. Instead, frame 530 includes flat first and second opposing major surfaces 545*a*, 545 of insertion end 540 that connect with an outer end 546. This design may be desirable where the curved lean-in describes with reference to FIG. 5A is not useful or otherwise not appropriate for a given situation.

FIG. 5C illustrates yet another embodiment of a frame 550 including drafted surfaces. In this embodiment, insertion end 560 includes first and second opposing major surfaces 570*a*, 570*b* that are drafted at draft angle 575. Draft angle 575 may range between about 0.1 to 1.0 degrees, e.g., 0.5 or 0.25 degrees. In some embodiments only one of surfaces 570*a*, 570*b* may include a draft angle. In other embodiments, other surfaces of frame 530 may be drafted in addition to or instead of surfaces 570*a*, 570*b*. Drafted surfaces 570*a*, 570*b* may result from the method of manufacture as described below.

As discussed above, the flanged end of frames according to the present invention may vary from those embodiments illustrated in FIGS. 3A-3F and 4A-4D. An example of one particular flanged end variation is shown in the following figures.

Figure 6A:
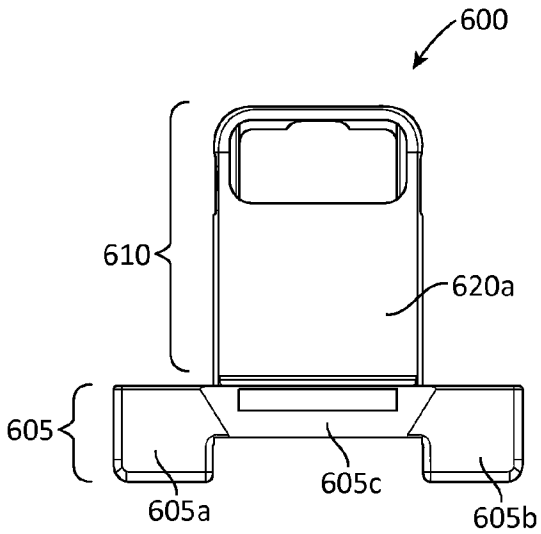
FIGS. 6A-6F illustrate another ground ring or frame according to an embodiment of the present invention.
Figure 6B:
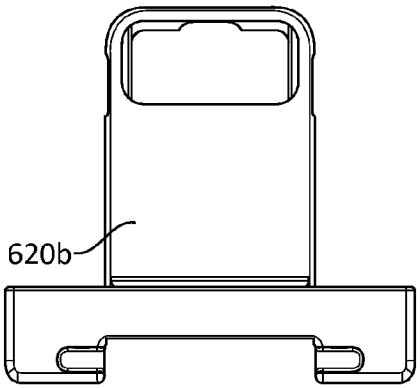
Figure 6C:
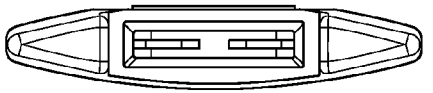
Figure 6D:
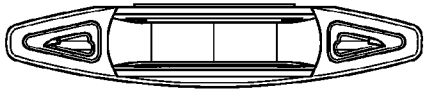
Figure 6E:
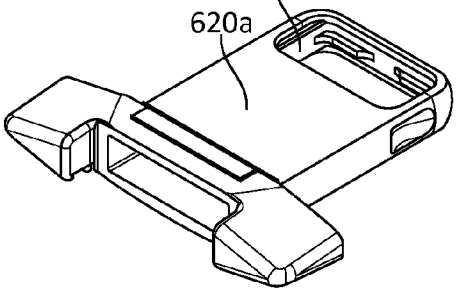
Figure 6F:
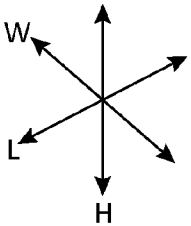
Figure 6F:
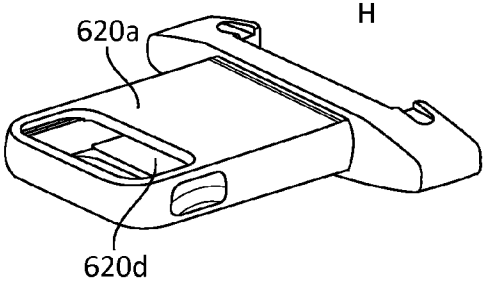

FIGS. 6A-6F illustrate a ground ring or frame 600 according to an embodiment of the present invention. FIGS. 6A-6D are top, bottom, back and front views, respectively, of ground ring or frame 600 according to an embodiment of the present invention. FIGS. 6E and 6F are perspective views of frame 600. Similar to frame 300 discussed above, frame 600 may include a flanged end 605 and an insertion end 610 that extends longitudinally away from flanged end 605 in a direction parallel to the length dimension of frame 600. Insertion end 610 may include first and opposing major surfaces 620*a*, 620*b*. Insertion end 610 may include all the same features and incorporate also the same variations as described above with regards to insertion end 310 (shown in FIGS. 3A-3F). However, flanged end 605 may include a number of variations not specifically discussed above with regards to flanged end 305.

As shown in FIGS. 6A-6F, flanged end 605 may be wider in the width dimension than flanged end 305 and include geometry such as wings 605*a*, 605*b* connected by a base portion 605*c*. The wider flanged end 605 may help spread the load when torque is applied to insertion end 610. Depending on the particular application of a plug connector, frame 600 may help prevent damage to a plug connectors including frame 600 and corresponding receptacles mated with frame 600 when torque is applied to the plug connector.

FIGS. 7A and 7B are cross sectional perspective views of two opposing portions of frame 600. FIGS. 7A and 7B illustrate a portion of the cavity and inner surfaces of frame 600, some of which may not have been visible in FIGS. 6A-6F. As shown in FIGS. 7A and 7B, the inner surfaces of flanged end 605 may be tapered. As with the geometry of the inner surfaces of flanged end 305, the geometry of the inner surfaces of flanged end 605 may be due in part to the process by which frames according to the present invention may be formed. Frame 600 may also be formed through a metal injection molding process wherein the molten material is injected into a mold through a portion of the mold corresponding to flanged end 605 of frame 600. As such, this tapered geometry may be designed to eliminate sharp corners near the flanged end 605 in order to optimize the flow of material injected into a mold in order to form frame 600.

For example, as shown in FIGS. 7A and 7B, flanged end 605 may include tapered first and second opposing surfaces 694*a*, 694*b* and tapered third and fourth opposing surfaces 694*c*, 694*d*. The tapered surfaces may connect with corresponding inner surfaces of insertion end 610, e.g., third and fourth opposing inner surfaces 650*c*, 650*d* (shown in FIG. 6D) and first and second opposing inner surfaces 650*a* (shown in FIG. 6E), 650*b*. Tapered sidewalls 694*a*-694*d* may be drafted at draft angle 695. For example, draft angle 695 of tapered sidewalls 694*a*-694*d* may be between 5 and 35 degrees or 10 and 30 degrees. In some embodiments, sidewalls 694*a*-694*d* may be drafted at different draft angles, e.g., some may have a draft angle of 17 degrees and the others 10 degrees.

Although flanged end 605 is shown in FIGS. 6A-6F and 7A-7B as having a particular geometry, other embodiments of the present invention may include a other wider or narrower flanged end geometries. A variety of variable thickness, width and height flanged ends may be included in embodiments of the present invention.

Ground rings or frames described herein, e.g., frames 300 and 600, may be made from a variety materials including metals, dielectrics or a combination thereof. For example frames according to the present invention may be made from stainless steel or conductive polymers. In some embodiments, frames according to the present invention may be may made from a single piece of electrically conductive material, e.g., stainless steel 630.

As discussed above, frame designs of the present invention may take into account the their method of manufacture. A number of different methods of manufacturing frames of the present invention may be suitable for frames of the invention. Examples of these methods are shown in the following figures.

IV. Methods of Manufacture

Embodiments of the present invention may provide a plug connector ground ring or frame that may be easily manufactured. For example, techniques such as a metal injection modeling (MIM) in combination with machining and finishing operations may be used to form frames of the invention.

Figure 8A:
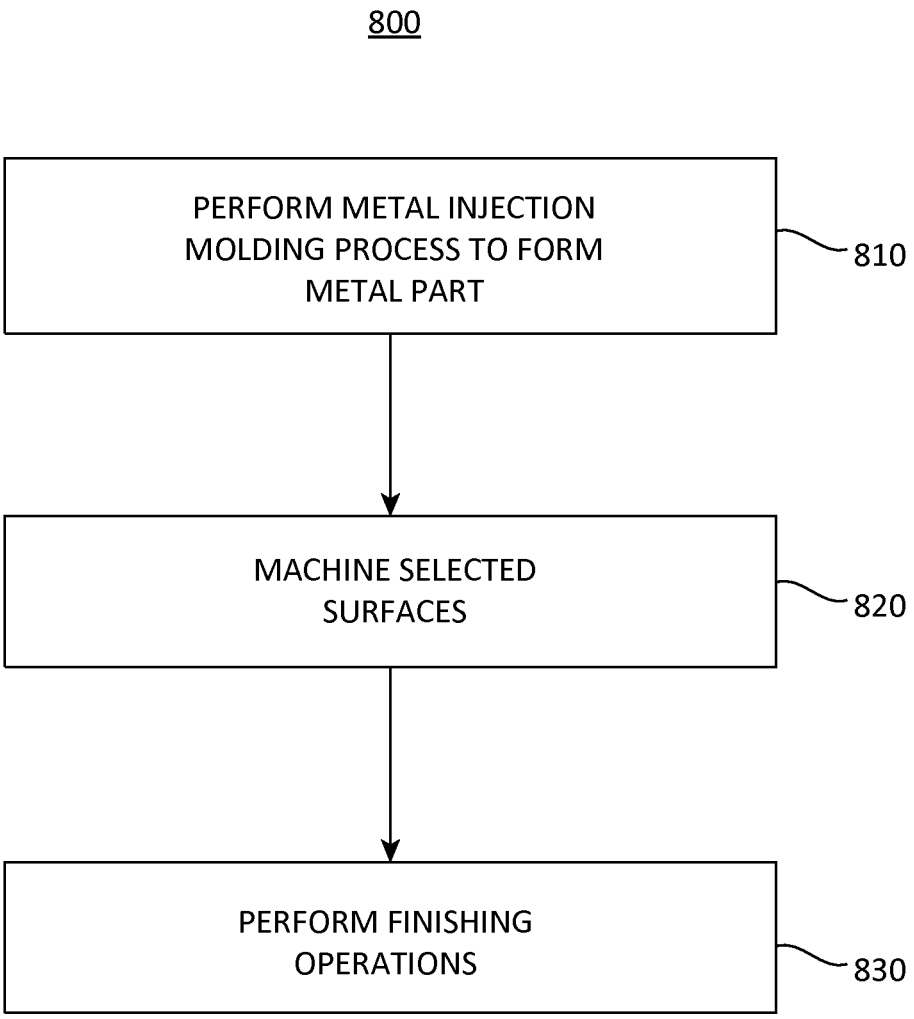
FIG. 8A illustrates an overview of a method of manufacture according to embodiments of the present invention.

FIG. 8A illustrates an overview of a method of manufacture according to embodiments of the present invention. This figure, as with the other included figures, is shown for illustrative purposes and does not limit either the possible embodiments of the present inventions or the claims.

As shown in FIG. 8A, method 800 includes three general steps. At the first step, step 810, a MIM process is performed in order to form a metal part. At step 820, select surfaces of the metal part are machined. Lastly, at step 830, finishing operations are performed on the metal part to complete the manufacture of a ground ring or frame. These steps may be used to form embodiments of frames 300 and 600 described above.

Figure 8B:
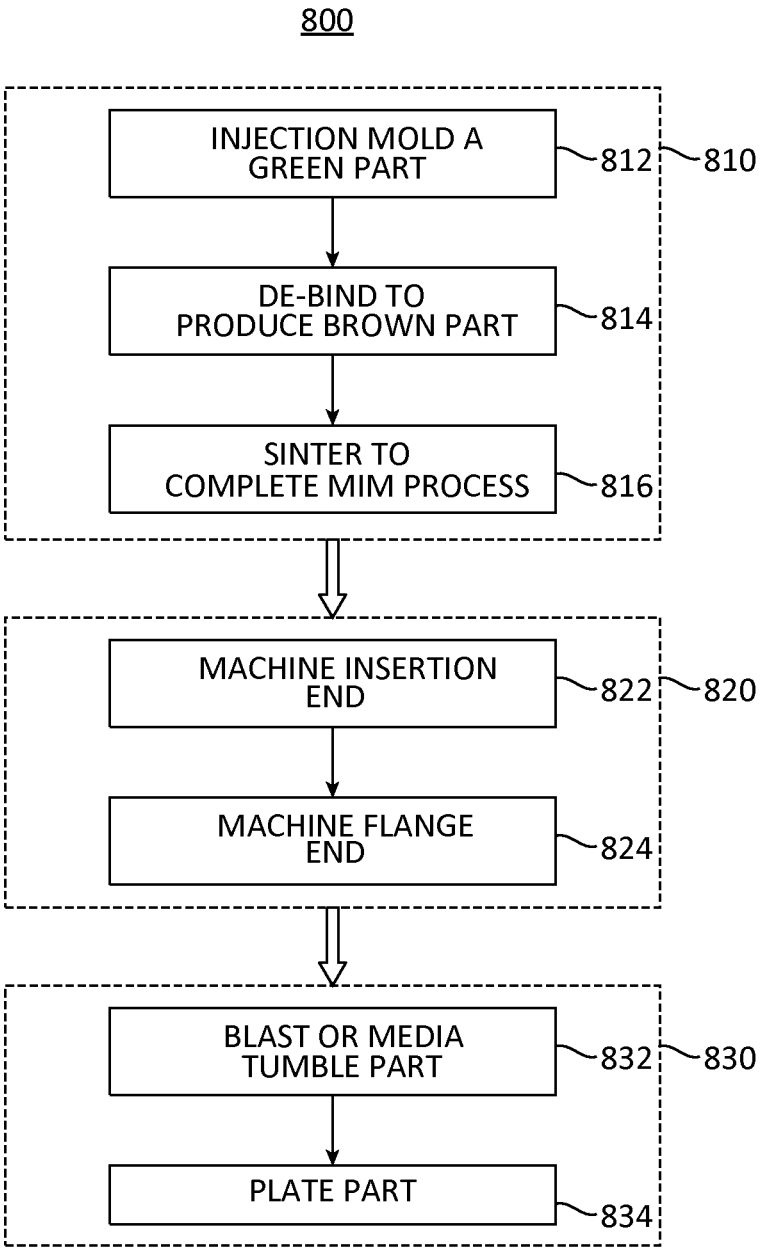
FIG. 8B illustrates sub-steps steps for performing each of the steps of the method of FIG. 8A.

FIG. 8B illustrates sub-steps steps for performing each of the steps of method 800. Examples of these sub-steps are discussed below.

MIM step 810 includes three sub-steps: steps 812, 814 and 816. At step 812, a green part or green frame is molded. To produce the green part, a MIM feedstock is blended and injected into a molding machine in molten form. Once the liquefied feedstock cools, it may be de-molded in the molding machine. The feedstock may include variety of elements chosen to produce a metal part with particular characteristics. In one embodiment, a feedstock for use with the invention may include atomized metal powder, a thermoplastic polymer and wax based plastic. The atomized metal power may be an atomized steel power, e.g., atomized steel 630 powder. The thermoplastic polymer may provide the plastic binding agent for the MIM process and the wax based plastic may provide the wax binding agent for the MIM process.

At step 814, the binders are removed (de-binded) from the green part to produce a brown part or brown frame. The binding material may be removed using heat, solvents (e.g., nitric acid), and/or other methods or a combination thereof.

At step 816, the brown part is sintered to produce a MIM part or frame and the MIM process is completed. The sintering process includes subjecting the brown part to temperatures that cause the atomized metal powders to bind together and form the MIM part or frame.

The MIM process may also result in parts having a number of characteristics typically associated with the MIM process. For example, the outer surfaces of frames, e.g., embodiments of frames 300 and 600 described above, manufactured according to step 810 may include an outer skin layer or outer layer that has different properties than a remainder of the frame. For example, surfaces 320*a*, 320*b*, 325*a*, 325*b* and 340 (shown in FIGS. 3A-3F) all may include an outer layer that has different properties than a remainder of material below the outer layer where frame 300 is formed by a MIM process (e.g., step 810). The remainder material of a given side may extend between an outer layer on an outer surface or side, e.g., 320*a*, and an outer layer on a corresponding inner surface or side of the frame, e.g., surface 350*c* may correspond to outer surface 320*a*. The outer layer may have a thickness of less than around 1000 microns and between 200 and 800 microns in some embodiments.

The outer layer of a given side surface may have a porosity less than the porosity of remainder material of the side. Additionally, the outer layer of a given side may also have a greater density and/or greater surface hardness than the remainder of the side. In some embodiments, outer layers of surfaces of frames may possess all three or some combination thereof of the characteristics described above—decreased porosity, increase density, and increased surface hardness—relative to the remainder of each respective surface or side.

In some embodiments, implementing a MIM process, e.g., step 810 above, to produce a frame may be desirable because it provides flexibility in achieving a desired geometry and can result in a molded part that is close to the final desired shape, which in turn, may require less machining Machining may still be required for some features, e.g., retention features, but these may be easily machined into the sides of the ground ring or frame after it is formed and then surfaces of the ground ring or frame can be smoothed using blasting process and then plated, as described above.

Although a particular method of manufacturing a frame according to the invention is discussed above, embodiments of the invention may include manufacturing the frame by other methods, including pressed powder sintering, investment casting, and simply computer numerical control (CNC) machining.

At the conclusion of the MIM process (step 810), surfaces of the frame may be machined at step 820. For example, at step 822, surfaces of the insertion end (e.g., 310, 610 above) may be machined. And at step 824, surfaces of the flanged end may be machined. A further discussion regarding which surfaces are machined, why those surfaces are machined, and the resulting characteristics of the machined surfaces with be discussed in detail below with regards to FIGS. 9A and 9B. The machining of step 820 may be accomplished by a CNC machine, a grinding machine or other suitable machinery.

At the conclusion of the machining operation (step 820), finishing operation may be performed on the frame at step 830. For example, at step 832, the frame may enter a sandblasting machine and/or a tumbling machine. In some embodiments, the media tumbling may be performed before the blasting. These machines may be used to removes burrs from the frame and polish the surface of the frame. At step 834, a plating operation may be performed on the frame. For example, a nickel plating operation may be implemented. In some embodiments, the plating process may be a nickel electroplating process using nickel sulfate or an electroless nickel plating process, e.g., high phosphorus electroless nickel. For nickel electroplating, the plating process make include a number of steps such as electrolytic degreasing, rinsing with pure water, activating acid, rinsing with pure water, nickel pre-plating, rinsing with pure water, nickel plating, rinsing with pure water, rinsing with hot pure water, cooking in an oven, and drying on a counter. Alternatively, other standard nickel electroplating processes and electroless nickel plating processes may be used at step 834.

As mentioned above, the machining of the frame in method 800 may only pertain to specific surfaces of the insertion and flanged ends of a frame. Examples of machining step 820 are included in the following figures.

Figure 9A:
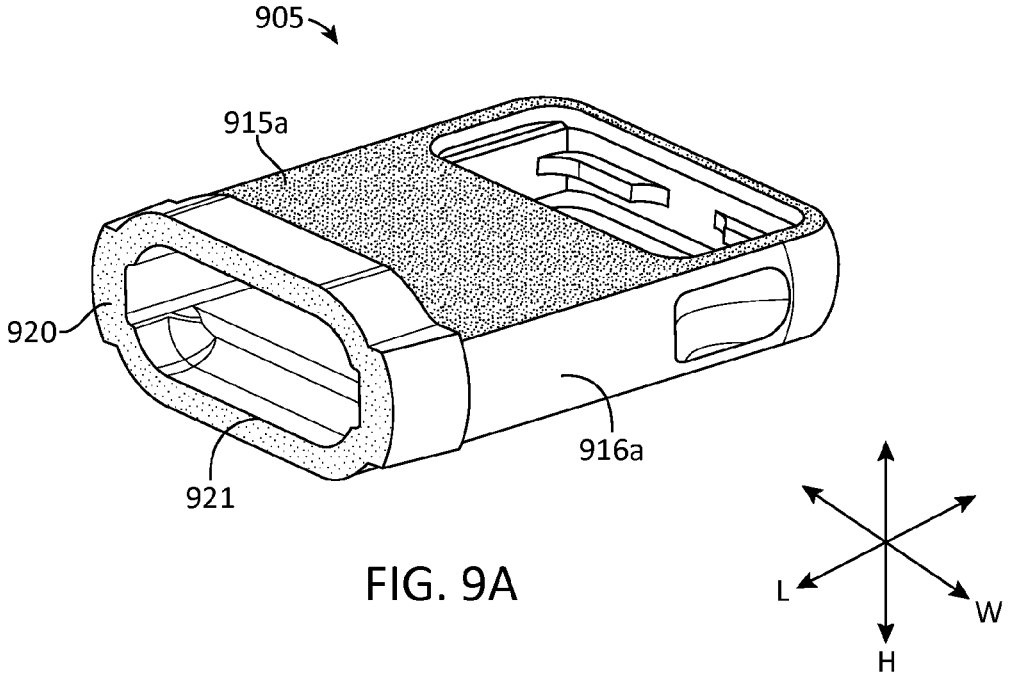
FIGS. 9A and 9B illustrate frames having machined surfaces according to the present invention.
Figure 9B:
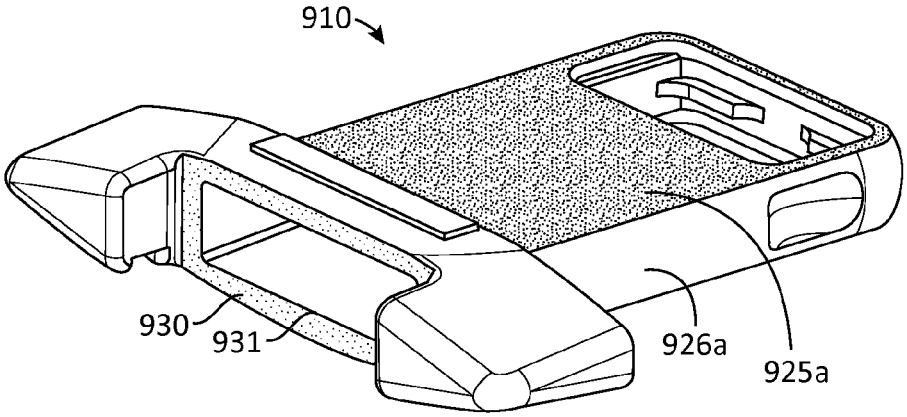

FIGS. 9A and 9B illustrate frames 905 and 910 having machined surfaces according to the present invention. Machining surfaces of a frame may serve a number of functions, including reducing or eliminating the draft angle of drafted surfaces (e.g., surfaces 570*a*, 570*b*), providing a cosmetic finish, reducing surface roughness, and/or more precisely controlling tolerances of frames formed in a MIM process.

FIG. 9A illustrates a frame 905 manufactured according to embodiments of step 810 above and having machined surfaces as indicated by hatch patterns. Frame 905 includes first and second major opposing surfaces 915*a* and 915*b* (not shown in FIG. 9A) as well as first and second opposing side surfaces 916*a* and 916*b* (not shown in FIG. 9A). Frame 905 may also include a flanged end surface 920 surrounding opening 921.

In some embodiments, surfaces 915*a*, 915*b* may be machined according to step 820 (as indicated by a first hatch pattern) while surfaces 916*a*, 916*b* may not be machined. For example, the outer layers (as defined in above with reference to step 816) of surfaces 915*a*, 915*b* may be machined to reduce their respective outer layer thicknesses by 10-200 microns. Accordingly, in this embodiment, the outer layers of surfaces 916*a*, 916*b* may be thicker than the outer layers of 915*a*, 915*b*. As mentioned above, machining a surface may reduce its surface roughness. Accordingly, surfaces 915*a*, 915*b* may have a surface roughness that is less than the surface roughness of surfaces 916*a*, 916*b*. Again, the machining of surfaces 915*a*, 915*b* may also be used to remove the draft on those surfaces.

Alternatively, or in addition to the machining of surfaces 915*a* and 915*b*, flanged end surface 920 may be machined to reduce its outer layer thickness by 50-300 microns (as indicated by a second hatch pattern). The machining of surface 920 may aid in achieving tighter tolerances for frame 900 such that it may be fitted in custom overmolding tooling for additional assembly steps as described above. In addition, the surface roughness of flanged end surface 320 may be decreased.

FIG. 9B illustrates a frame 910 manufactured according to embodiments of step 810 above and having machined surfaces as denoted by hatch patterns. Similar to frame 905, frame 910 may include machined surfaces as described with reference to FIG. 9A. However, a flanged end surface 930 including opening 931 may be machined to reduce its outer layer according to a range of smaller values than that of outer flange surface 920 of FIG. 9A. For example, flanged end surface 930 may be machined to reduce its outer layer by 10-200 microns, instead of 50-300 microns.

Although FIGS. 9A and 9B illustrate particular surfaces of frames 905 and 910 are machine and machined to reduce the thickness outer layers of surfaces by particular amounts, other embodiments of the present invention may include frames having different surfaces machined and/or outer layer thicknesses reduced by different amounts.

As mentioned above, the machining of step 820 may be accomplished by a number of different machining tools. One particular machining method using a double-disk grinding machine will be described in greater detail in relation to the following figures.

Figure 10A:
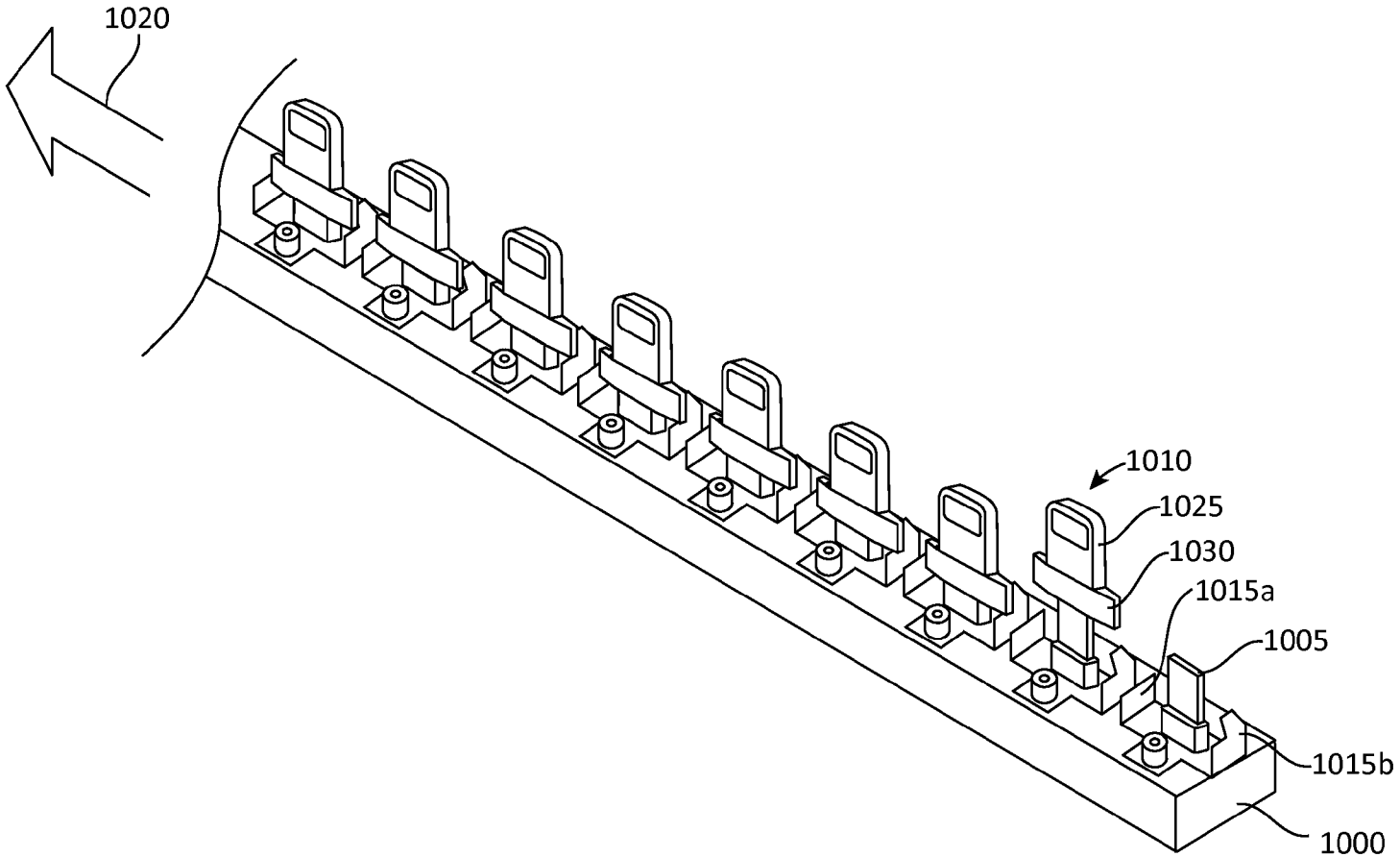
FIG. 10A illustrates a simplified perspective view of a guide rail for routing frames according to embodiments of the present invention into contact with disks of a double-disk grinding machine.

FIG. 10A illustrates a simplified perspective view of a guide rail 1000 for routing frames according to embodiments of the present invention into contact with disks of a double-disk grinding machine. Guide rail 1000 may include supports 1005 for coupling frames 1010 to guide rail 1000. Retention features 1015*a*, 1015*b* may secure frames 1010 on supports 1005. Supports 1005 may orient frames 1010 in vertical direction with respect to feed direction 1020 of guide rail 1000. Supports 1005 may also position frames 1010 relative to a double-disk grinding machine (shown in FIG. 13) such that only the insertion end or portion 1025 of frame 1010 is machined by the double-disk grinding machine during a grinding operation by the double-disk grinding machine. A flanged end or portion 1030 may be positioned by guide rail 1000 such that it does not come into contact with the double-disk grinding machine while the insertion portion is being machined.

Figure 10B:
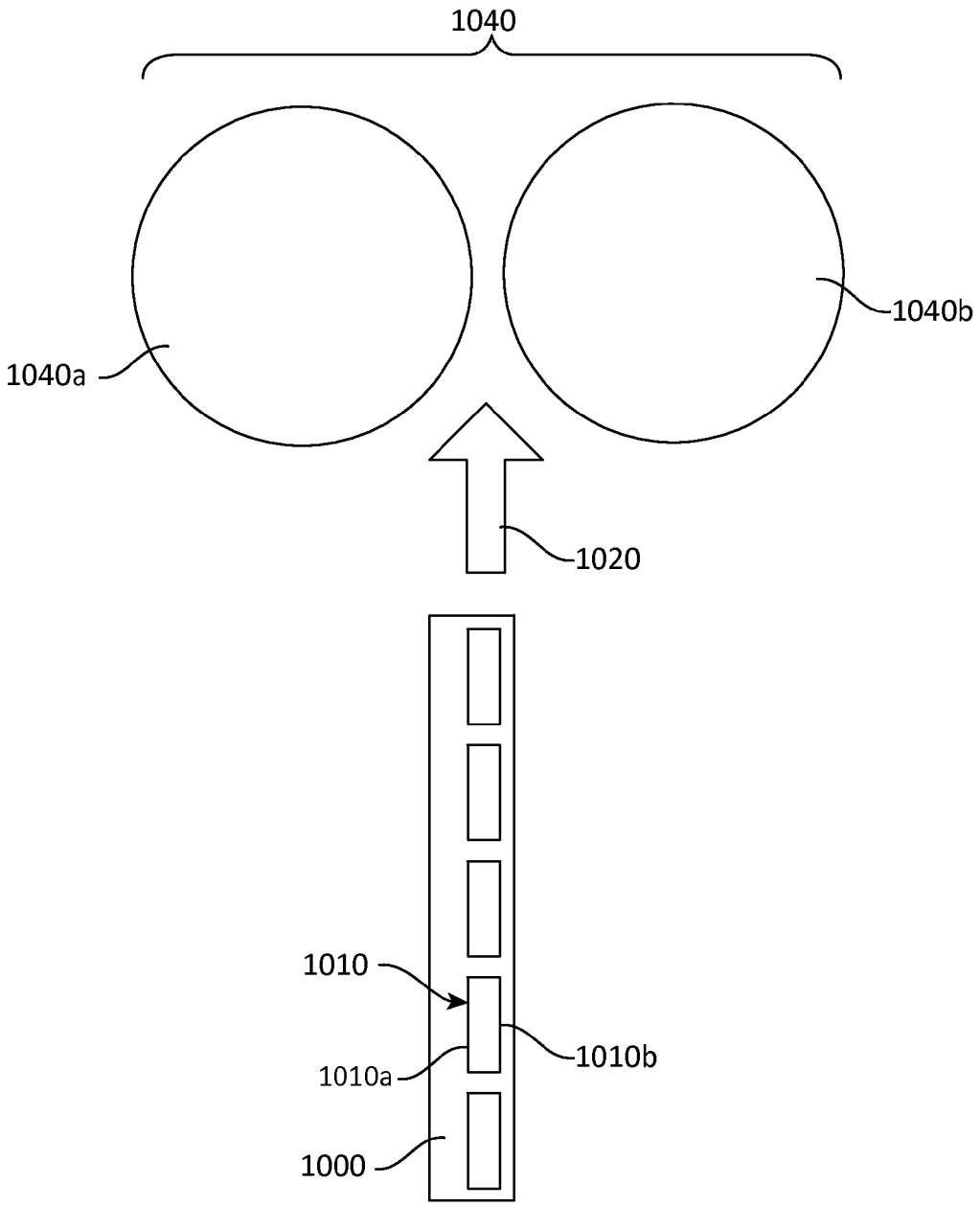
FIG. 10B illustrates a simplified top view of a guide rail routing frames into a double-disk grinding machine.

FIG. 10B illustrates guide rail 1000 routing frames into a double-disk grinding machine 1040. Double-disk grinding machine 1040 includes first and second grinding disks 1040*a*, 1040*b*. When fed into grinding machine 1040, front and back sides 1010*a*, 1010*b* of insertion portion 1025 (shown in FIG. 10A) of frame 1010 are simultaneously machined by disks 1040*a*, 1040*b*, respectively. As discussed above, the flanged end 1030 (as shown in FIG. 10A) is positioned by guide rail 1000 such that it is not machined by grinding machine 1040 while the insertion end 1025 (shown in FIG. 10A) is being machined.

The double disk grinding machine arrangement described above may allow for high-volume production of frames of the present invention that require the machining of their insertion ends. Although FIGS. 10A-10B are illustrated and described as only allowing for the machining of the insertion end of a frame according to the present invention, other embodiment may modify this arrangement so as to machine other surfaces of the frames of the invention.

In addition to MIM in combination with machining and/or finishing operations, a number of other methods may be used for manufacturing the plug connector frames described herein. These alternatives may provide increased production speed and/or obviate the need for secondary operations associated with MIM, which secondary operations may be time consuming or require the use of already strained manufacturing resources. Examples of these methods are shown in the following figures.

V. Alternative Methods of Manufacture

Metal working processes such as machining, stamping, forging, and cold heading as well as die casting, injection molding and combinations thereof may also be used to manufacture embodiments of grounds rings or plug connector frames described herein. Some of the methods described below may be used to manufacture two pieces of a plug connector frame, which two pieces are assembled together in order to form the plug connector frame—two-piece methods. Other methods described below may be used to a manufacture an integral plug connector frame formed from a single piece of material—one-piece methods. These two-piece and one-piece methods of manufacturing plug connector frames are discussed in turn below.

A. Two-Piece Methods of Manufacture

Several two-piece methods may be used to manufacture plug connector frames described herein. Examples of these methods are described in this section.

Figure 11:
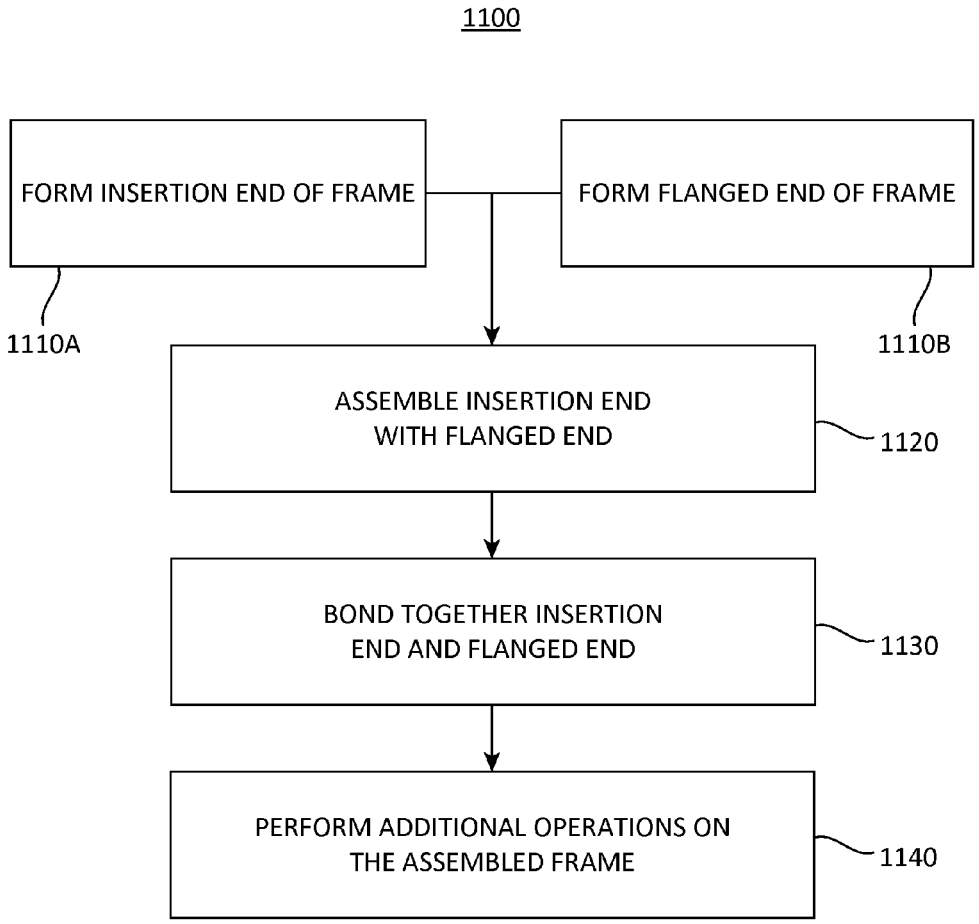
FIG. 11 illustrates a general two-piece method of manufacturing a plug connector frame according to embodiments of the present invention.

FIG. 11 illustrates a general two-piece method of manufacturing a plug connector frame according to embodiments of the present invention. The first steps of method 1100, steps 1110*a* and 1110*b*, may take place concurrently or at different times. At steps 1110*a* and 1110*b*, an insertion end and a flanged end, respectively, of a plug connector frame may be formed. At step 1120, the insertion end may be assembled with the flanged end to form the plug connector frame. At step 1130, the insertion and flanged ends may be bonded together via, e.g., laser welding. In some embodiments, as discussed below, step 1130 may not be required, e.g., where insertion and flanged ends are secured together with an interference fit or a mechanical interlock. At step 1140, additional operations may be performed on the assembled frame, e.g., overmolding.

Method 1100 may be performed in various orders or sequences with more or less steps. Each step of embodiments of method 1100 is discussed in detail below with regards to the figures in this section.

Figure 12A:
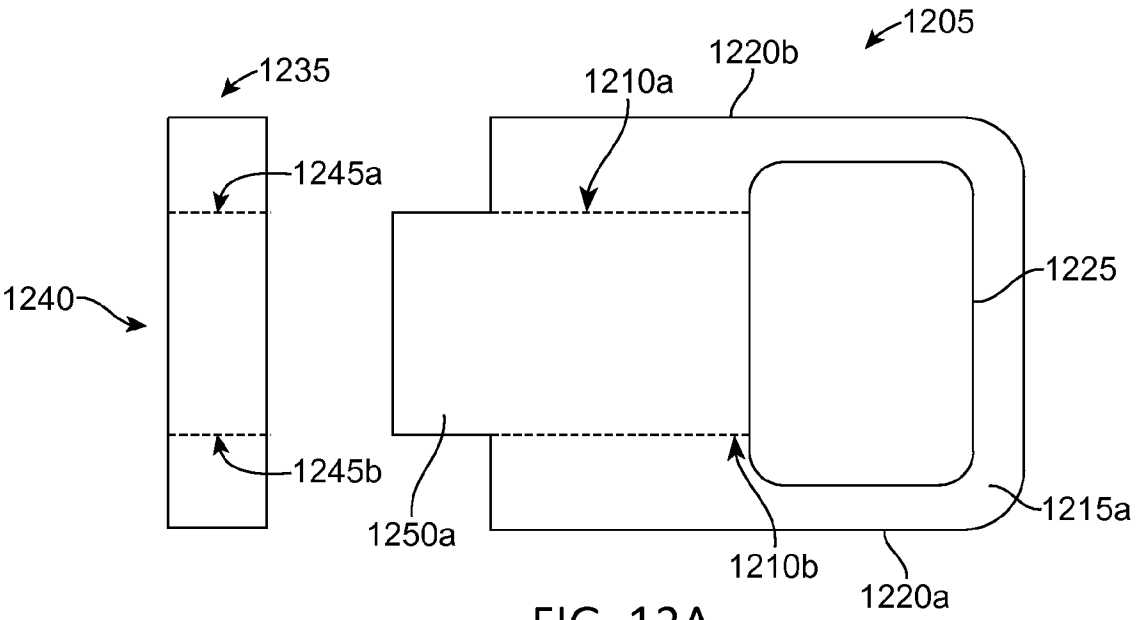
FIGS. 12A and 12B illustrate simplified top and side plan views, respectively, of insertion and flanged ends of a plug connector frame manufactured according to an embodiment of the method of FIG. 11.
Figure 12B:
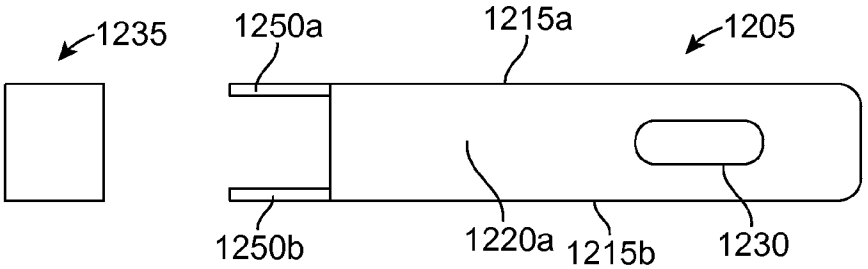

FIGS. 12A and 12B illustrate simplified top and side plan views, respectively, of insertion and flanged ends of a plug connector frame manufactured according to an embodiment of method 1100. At step 1110*a* of this embodiment, an insertion end 1205 may be formed by forging, stamping or cold heading. For example, insertion end 1205 may be cold headed by pressing, e.g., using a punch and/or a blade, a metal blank into successive dies thereby forming an insertion end including an opening (not shown in FIGS. 12A and 12B) that communicates with a cavity defined in part by opposing inner surfaces 1210*a*, 1210*b*. In contrast, a stamped or forged insertion end 1205 may require machining to form inner surfaces of insertion end 1205, e.g., 1210*a* and 1210*b*.

Regardless of whether forging, stamping or cold heading is used, insertion end 1205 may include first 1215 and second opposing major surfaces 1215*a*, 1215*b* and first and second opposing side surfaces 1220*a*, 1220*b*. Stamping or machining may be used to form first 1225 and second (not shown in FIGS. 12A and 12B) openings on first and second major surfaces 1215*a*, 1215*b*, respectively. The first opening 1225 may be registered with the second opening. Stamping or machining, e.g., with a keyseat cutter, may also be used to form first 1230 and second (not shown in FIGS. 12A and 12B) detents on first and second side surfaces 1220*a*, 1220*b*, respectively.

At step 1110*b* of this embodiment, a flanged end 1235 may be similarly formed by forging, stamping or cold heading. Flanged end 1235 may include an opening 1240 that communicates with a cavity partially defined by opposing inner surfaces 1245*a*, 1245*b*.

At step 1120 of this embodiment, insertion end 1205 may be assembled with flanged end 1235 to form a frame, e.g., frames 300 and 600 shown in FIGS. 3A-3F and 6A-6F, respectively. When insertion and flanged end 1205 and 1235 are assembled together, the flanged end opening 1240 may communicate with a cavity that extends from the flanged end 1240 into the insertion end 1205 past the first 1225 and second (not shown in FIGS. 12A and 12B) openings.

At step 1130 of this embodiment, insertion and flanged ends 1205, 1235 may be bonded together via, e.g., laser welding. Alternatively, flaps 1250*a*, 1250*b* may provide an interference fit between insertion and flanged ends 1205, 1235 when assembled together to hold insertion and flanged ends 1205, 1235 together.

Step 1140 may not be required in this embodiment.

Insertion and flanged ends 1205, 1235 may be made from a metallic material, e.g., 300 or 400 series stainless steel.

Another embodiment of a two-piece method for manufacturing plug connector frames described herein is shown in the following figures.

Figure 13A:
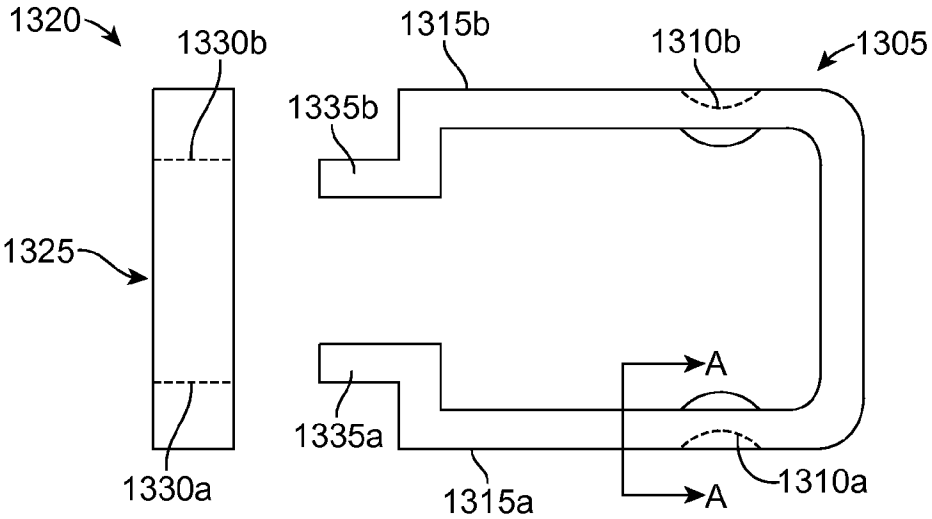
FIGS. 13A and 13B illustrate simplified top and side plan views, respectively, of wire insertion and flanged ends of a plug connector frame manufactured according to an embodiment of the method of FIG. 11.
Figure 13B:
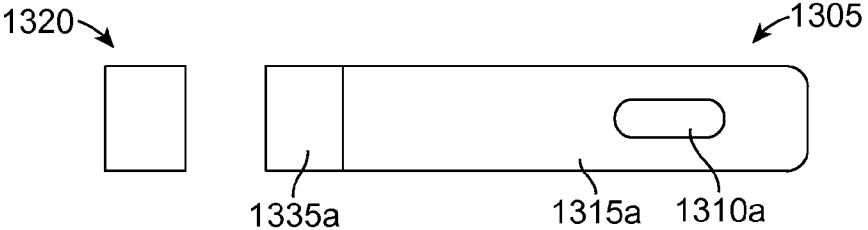
Figure 13C:
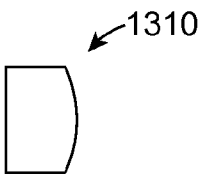
FIG. 13C illustrates a cross sectional view of the wire insertion end of FIG. 13A.

FIGS. 13A and 13B illustrate simplified top and side plan views, respectively, of wire insertion and flanged ends of a plug connector frame manufactured according to an embodiment of method 1100. FIG. 13C illustrates a cross sectional view of wire insertion end of FIG. 13A. At step 1110*a* of this embodiment, a wire insertion end 1305 may be formed by a wire bending machine, a CNC wire bending machine, or otherwise bent from wire or flat stock metal. For example, a wire 1310 having a cross section as shown in FIG. 13C, which is cross section A-A of FIG. 13A, may be fed into a wire bending machine to form wire insertion end 1305.

As shown in FIG. 13A, wire insertion end 1305 is shaped similar to the other insertion ends described herein except that it does not include first and second major opposing surfaces. Stamping (e.g., half shearing) or machining (e.g., with a keyseat cutter) may again be used to form first and second detents 1310*a*, 1310*b* on first and second side surfaces 1315*a*, 1315*b*, respectively.

At step 1110*b* of this embodiment, a flanged end 1320 may be formed by forging, stamping or cold heading as described above with reference to flanged end 1235 of FIGS. 12A-12B. Flanged end 1320 may include an opening 1325 that communicates with a cavity partially defined by opposing inner surfaces 1330*a*, 1330*b*.

At step 1120 of this embodiment, wire insertion end 1305 may be assembled with flanged end 1320.

At step 1130 of this embodiment, wire insertion and flanged ends 1305, 1320 may be bonded together via, e.g., laser welding. Alternatively, the contact between spring locks 1335*a*, 1335*b* and inner surfaces 1330*a*, 1330*b*, respectively, when the wire insertion and flanged ends 1305, 1320 are assembled together may provide an interference fit to secure wire insertion end 1305 and flanged end 1320 together. Flanged and wire insertion ends 1320, 1305 may also include corresponding mechanical interlocks (not shown in FIGS. 13A and 13B) to secure flanged and wire insertion ends 1320, 1305 together when assembled.

At step 1140 of this embodiment, the assembled and bonded together wire insertion and flange ends 1305, 1320 may be inserted into a mold of an injection molding machine in order to overmold additional features not shown in FIGS. 13A-13B through injection molding. For example, as a result of this insert molding process, first and second opposing major surfaces including first and second openings, respectively, may be formed over wire insertion end 1305, thereby forming an insertion end (e.g., insertion ends 310 and 610 shown in FIGS. 3A-3F and 6A-6F). The first opening may be registered with the second opening. Following the overmolding, the flanged end opening 1325 may communicate with a cavity that extends from the flanged end 1325 into the insertion end (a complete insertion end is not shown in FIGS. 13A and 13B) past the first and second openings of the first and second major surfaces, respectively.

In some embodiments, additional components, e.g., a PCB, contacts, a frame for the contacts, etc. as described in relation to FIGS. 2A-2F, may also be inserted into the mold during the insert molding process described above to simultaneously form portions of the plug connector frame as well as other portions of a plug connector.

Wire insertion and flanged ends 1305, 1320 may be made from a metallic material, e.g., 300 or 400 series stainless steel. The overmold material may be nylon (e.g., glass reinforced nylon), polyamides, or other suitable materials.

Yet another embodiment of a two-piece method for manufacturing plug connector frames described herein is shown in the following figures.

Figure 14C:
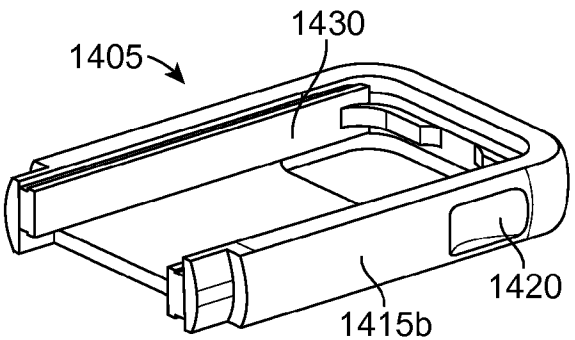
FIGS. 14B and 14C illustrate simplified top and bottom perspective views, respectively, of a partial insertion end of a frame manufactured according to the embodiment of the method of FIG. 14A.
Figure 14B:
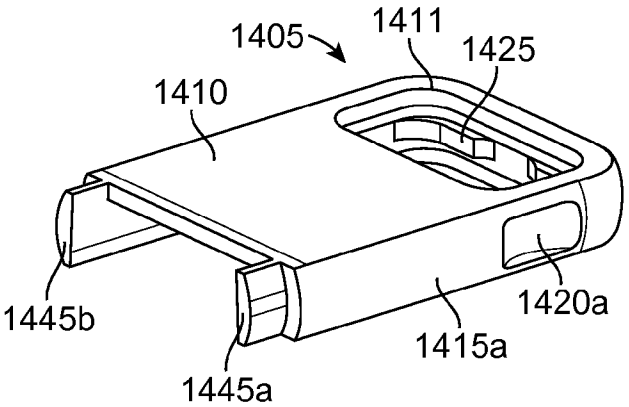
Figure 14A:
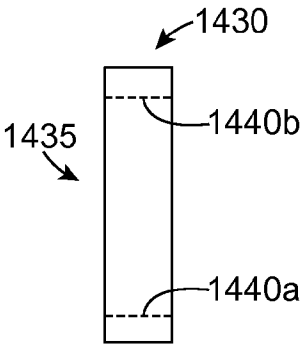
FIG. 14A illustrates a top plan view of a flanged end of a plug connector frame manufactured according to an embodiment of the method of FIG. 11.

FIG. 14A illustrates a top plan view of a flanged end of a plug connector frame manufactured according to an embodiment of method 1100. FIGS. 14B and 14C illustrate simplified top and bottom perspective views, respectively, of a partial insertion end of a frame manufactured according to the embodiment of method 1100 of FIG. 14A. At step 1110*a* of this embodiment, a stamping process may be used to form partial insertion end 1405. This stamping process forms insertion end 1405, which includes a first major surface 1410 having a first opening 1411 but does not include a second major surface. Partial insertion end 1405 may also include first and second side surfaces 1415*a*, 1415*b* having first and second detents 1420*a*, 1420*b*, respectively. Stamping and machining, as described above in relation to detents 1230 or 1310*a*, 1310*b*, may be used to form detents 1420*a*, 1420*b*. Machining may also be used to form features such as a ledge 1420 and an interlock 1425.

At step 1110*b* of this embodiment, a flange end 1430 may be formed. Again, flanged end 1430 may be formed by forging, stamping or cold heading as described above. Flanged end 1430 may include an opening 1435 that communicates with a cavity partially defined by opposing inner surfaces 1440*a*, 1440*b*.

At step 1120 of this embodiment, partial insertion end 1405 may be assembled with flanged end 1430.

At step 1330 of this embodiment, partial insertion and flanged ends 1405, 1430 may be bonded together via, e.g., laser welding. Alternatively, extensions 1445*a*, 1445*b* may provide an interference fit with inner surfaces 1440*a*, 1440*b* to secure partial insertion end 1405 and flanged end 1430 together.

At step 1140 of this embodiment, additional operations may be performed on partial insertion and flanged end 1405, 1430. For example, partial insertion and flange ends 1405, 1430 may be inserted into a mold of an injection molding machine in order to overmold additional features not shown in FIGS. 14A-14C. For example, this insert molding process may be used to form a second major surface opposite the first major surface 1410, thereby forming an insertion end (e.g., insertion ends 310 and 610 shown in FIGS. 3A-3F and 6A-6F). The second major surface may include a second opening registered with first opening 1411. Following the overmolding, the flanged end opening 1435 may communicate with a cavity that extends from the flanged end 1430 into the insertion end (a complete insertion end not shown in FIGS. 14A-14C) past the first 1411 and second openings (not shown in FIGS. 14A-14C).

In some embodiments, additional components, e.g., a PCB, contacts, a frame for the contacts, etc. as described in relation to FIGS. 2A-2F, may also be inserted into the mold during the insert molding process described above to simultaneously form portions of the plug connector frame as well as other portions of a plug connector.

Although the two-piece methods of manufacture described above were described with reference to plug connector frames illustrated in FIGS. 12A, 12B, 13A, 13B and 14A-14C, the methods of manufacture described above may be used to form any of the plug connector frames described herein, e.g., frames 300 and 600 shown in FIGS. 3A-3F and 6A-6F, respectively. In other embodiments, embodiments of two-piece methods of manufacture may be used to form insertion and flanged ends that are otherwise shaped.

As mentioned earlier, one-piece methods of manufacture may also be used to form plug connector frames according to the present invention. The one-piece methods may require fewer steps and less manufacturing time than the two-piece methods. In addition, in situations where access to computer numerical control (CNC) machining tools is limited for any number of reasons, one-piece manufacturing methods may be a desirable alternative. Examples of these methods are discussed in the next section.

B. One-Piece Method of Manufacture

Several one-piece methods may be used to manufacture plug connector frames described herein from a single piece of material. Examples of these methods are described in this section.

Figure 15A:
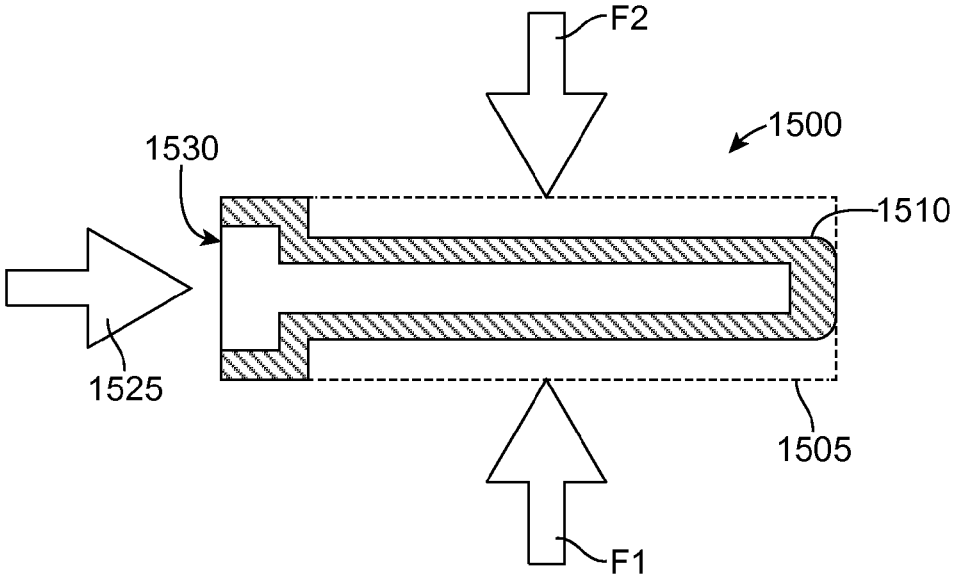
FIGS. 15A and 15B illustrate cross section and top views of a plug connector frame at different stages of manufacture according to a method of the present invention.
Figure 15B:
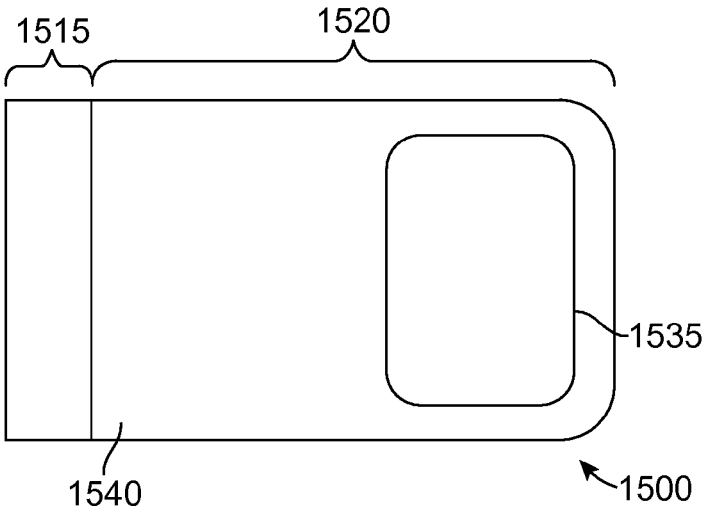

FIGS. 15A and 15B illustrate cross section and top views of a plug connector frame at different stages of manufacture according to a method of the present invention. In this embodiment, a plug connector frame 1500 may be formed by a combination of deep drawing and stamping. Deep drawing may be used to form a net frame shape 1505 of frame 1500, as represented by dotted lines. For example, the net shape may be formed by pressing a sheet metal blank into a die adapted for forming net shape 1505. After deep drawing net frame shape 1505, stamping may be used to form a final frame shape 1510 of frame 1500. Final frame shape 1510 includes a flanged end 1515 and an insertion end 1520, which ends may be formed by inserting a mandrel in a mandrel insertion direction 1525 and into opening 1530. The mandrel may be sized so as to form final frame shape 1510 of frame 1500 when stamping forces F1 and F2 press net frame shape 1505 of frame 1500 against the mandrel.

Frame 1500 may also include first 1535 and second (not shown in FIGS. 15A-15B) openings on first 1540 and second (not shown in FIGS. 15A-15B) major opposing surfaces. The first opening 1535 may be registered with the second opening. In one embodiment, laser cutting may be used to form these openings because frame 1500 was formed with a sheet metal blank, which may result in thinner frame walls capable of being cut by laser cutting. In other embodiments, machining, stamping or other techniques may be used to form these openings. Frame 1500 may also include detents and/or a number of other features described herein, which features may be formed as described above. As shown in FIGS. 15A and 15B, flanged end opening 1530 may communicate with a cavity that extends from the flanged end 1515 into the insertion end 1520 past the first 1535 and second (not shown in FIGS. 15A and 15B) openings.

Alternatively, cold heading could be used to form a plug connector frame in a similar fashion using progressive dies that first form net frame shape 1505 and then final frame shape 1510. However, grinding or other machining may be required to remove rounded edges/corners, meet tolerance requirements and/or remove drafts related to the cold heading process.

In another one-piece method, a sheet metal forming process, e.g., deep drawing, may be used to directly form final frame shape 1510. An example of this deep drawing method is shown in the following figures.

Figure 16A:
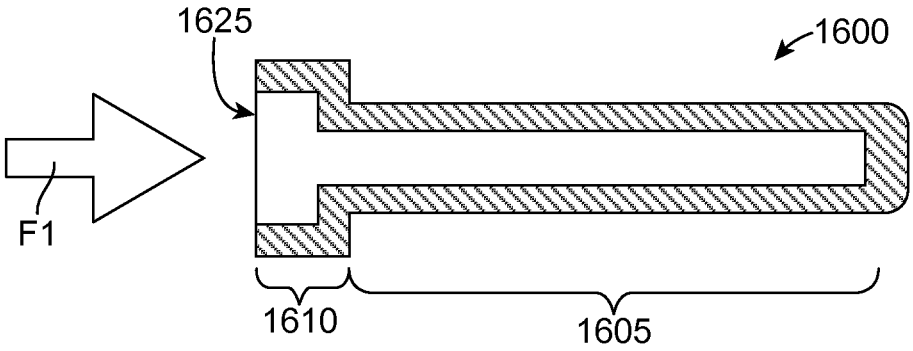
FIGS. 16A and 16B illustrate cross section and top views of a plug connector frame at different stages of manufacture according to a method of the present invention.
Figure 16B:
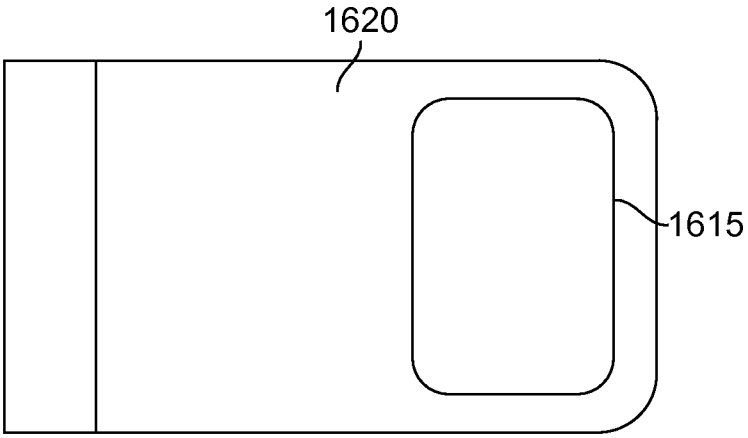

FIGS. 16A and 16B illustrate cross section and top views of a plug connector frame at different stages of manufacture according to a method of the present invention. In this embodiment, a plug connector frame 1600 may be formed by a punch or mandrel exerting a force F1 and drawing a sheet metal blank into a die adapted for forming insertion end 1605 and flanged end 1610. In order form frame 1600 by deep drawing alone, it may be necessary to use a sheet metal blank made from a material softer than steel, e.g., aluminum.

In this embodiment, laser cutting, machining or stamping may be used to form openings in frame 1600, e.g., opening 1615 on major surface 1620. Opening 1615 may be registered with a second opening positioned on a major surface opposite major surface 1620. Frame 1500 may also include detents and/or a number of other features described herein and may be formed according to methods of manufacture described above. As shown in FIGS. 16A and 16B, flanged end opening 1625 may communicate with a cavity that extends from the flanged end 1610 into the insertion end 1605 past the first 1615 and second (not shown in FIGS. 16A and 16B) openings.

In yet another one-piece method, deep drawing and cold heading and/or stamping may all be used to form a plug connector frame. An example of this method is shown in the following figures.

Figure 17B:
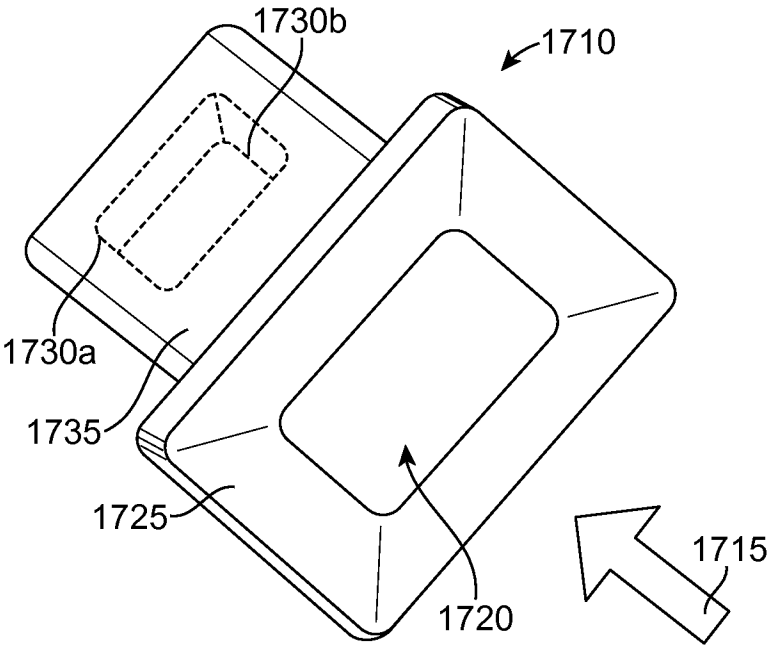
FIGS. 17A and 17B illustrate perspective views of a plug connector frame in different stages of manufacture according to a method of the present invention.
Figure 17A:
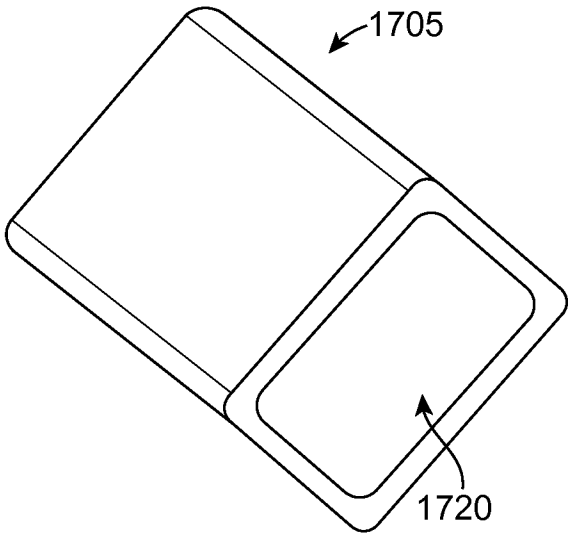

FIGS. 17A and 17B illustrate perspective views of a frame in different stages of manufacture according to a method of the present invention. In this embodiment, a net frame shape 1705 is formed by deep drawing. Thereafter, a mandrel, e.g., a tapered mandrel, may be inserted in a mandrel insertion direction 1715 and into opening 1720 in order to gradually flare out or cold head a rear flange 1725 to form a partially formed frame 1710. Alternatively, the frame material may be force over a mandrel rather the mandrel being inserted into opening 1720. An additional cold heading operation may be performed to fold back part of rear flange 1725 in order to form a flanged end, e.g., flanged ends 1515 and 1610 discussed above.

Stamping may also be used first form rear flange 1725 of partially formed frame 1710 and also to form a flanged end.

Frame 1710 may also include first and second openings 1730*a*, 1730*b* on first 1735 and second (not shown in FIGS. 17A and 17B) major opposing surfaces. As shown in FIG. 17B, first opening 1730*a* may be registered with second opening 1730*b*. In one embodiment, laser cutting may be used to form these openings because frame 1710 was formed with a sheet metal blank, which may result in thinner frame walls capable of being cut by laser cutting. In other embodiments, machining, stamping or other techniques may also be used to form these openings. Frame 1710 may also include detents and/or a number of other features described herein and may be formed according to methods of manufacture described above.

Although the one-piece methods of manufacture described above relate primarily to metal working processes, molding processes may also be used to form plug connector frames from a single piece of material. Examples of these molding methods of manufacture are discussed below.

Zinc die casting may be used to form plug connector frames according to the present invention (e.g., frames 300 and 600 shown in FIGS. 3A-3F and 6A-6F). This method may obviate the need for further operations while maintaining tolerances in the microns. Nevertheless, machining operations may still be used to achieve the required tolerances in some cases. Finishing operations may be performed on the zinc die casted frames, as with all frames discussed herein. For example, a sandblasting machine and/or a tumbling machine may be used to provide the frame with a cosmetic finish. However, zinc may be prone to scratching because it is a softer material. Accordingly, zinc die casted frames may be plated, e.g., using plating methods described above, to increase the surface hardness of the frame.

Alternatively, aluminum die casting may be used to form plug connector frames according to the present invention.

In other embodiments, injection molding may be used to form plug connector frames according to the present invention (e.g., frames 300 and 600 shown in FIGS. 3A-3F and 6A-6F) or even entire plug connectors (e.g., plug connector 100 shown in FIG. 1B). In order to form an entire plug connector, certain components (e.g., contacts and/or a PCB board) may be embedded in the plug connector and some of those components may be masked or arranged in a die such that they are not covered by material during the injection molding process. Alternatively, after the injection molding process, steps could be taken to remove material covering certain components (e.g., the contacts).

These injection molded plug connectors frames and plug connectors may be made from nylon, e.g., glass reinforced nylon, polyamides, or other suitable materials. In some embodiments, a plating operation may be performed on the injection molded plug connectors. For example, an electroless nickel plating process may be implemented. Alternatively, other standard electroless nickel plating processes may be used. The contacts may be masked during these plating operations such that they are not plated.

Although the one-piece methods of manufacture described above were described with reference to plug connector frames illustrated in FIGS. 15A, 15B, 16A, 16B, 17A and 17B, the methods of manufacture described above may be used to form any of the plug connectors described herein, e.g., frames 300 and 600 shown in FIGS. 3A-3F and 6A-6F, respectively. In other embodiments, embodiments of one-piece methods of manufacture may be used to form insertion and flanged ends that are otherwise shaped.

Also, while a number of specific embodiments were disclosed with specific methods, a person of skill in the art will recognize instances where the methods of one embodiment can be combined with the methods of another embodiment. For example, many of the other methods described herein may be used to manufacture different features and different embodiments of plug connector frames, some of these methods may be combined with other methods mentioned herein and various embodiments thereof. Also, those skilled in the art will recognize, or be able to ascertain using no more than routine experimentation, many equivalents to the specific embodiments of the inventions described herein. Such equivalents are intended to be encompassed by the following claims.

What is claimed is:

1. A method of manufacturing a metal frame for an electrical plug connector, the method comprising:

using a first metalworking process to form an insertion end of the metal frame, the insertion end having:

width, height and length dimensions; and first and second opposing sides extending in the width and length dimensions, the first side including a first opening and the second side including a second opening registered with and opposite the first opening, third and fourth opposing sides extending between the first and second sides in the height and length dimensions, an end surface extending in the width and height dimensions at a distal end of the insertion end between the first and second opposing sides and between the third and fourth opposing sides, and a third opening extending in the width and height dimensions opposite the end surface at a proximal end of the insertion end, wherein the first side includes a first portion that extends from the third opening to the first opening along the entire width of the first side and the second side includes a second portion that extends from the third opening to the second opening along the entire width of the second side; and using a second metalworking process to form a flanged end, the flanged end having:

width, height and length dimensions; and a flange opening extending through the flanged end in the length dimension; and thereafter, assembling the flanged end with the insertion end at the proximal end of the insertion end to form the metal frame for an electrical plug connector, wherein the flange opening communicates with the third opening forming a cavity that extends in the length, width and height dimensions from the flanged end into the insertion end.

2. The method of claim 1 wherein the first metalworking process includes one or more of machining, stamping, forging or cold heading.

3. The method of claim 1 wherein the second metalworking process includes one or more of machining, stamping, forging or cold heading.

4. The method of claim 1 wherein the first and second metalworking processes are the same process.

5. The method of claim 1 further comprising bonding together the insertion end and the flanged end.

6. The method of claim 1 further comprising machining or stamping first and second detents on the third and fourth sides of the insertion end, respectively.

7. The method of claim 1 wherein the insertion end and the flanged end are made from stainless steel.

8. The method of claim 1 wherein the insertion end is formed from a first metalworking process and an insert molding process.

9. The method of claim 8 wherein the first metalworking process is used to form the first, third and fourth sides of the insertion end and the insert molding process is used to form the second side of the insertion end.

10. The method of claim 9 wherein the insert molding process is further used to embed contacts within the first and second openings and a printed circuit board within the cavity.

11. The method of claim 8 wherein the first metalworking process includes one or more of machining, stamping, forging or cold heading.

12. The method of claim 8 wherein the second metalworking process includes one or more of machining, stamping, forging or cold heading.

13. A method of manufacturing a metal frame for an electrical plug connector, the method comprising:

using a sheet metal forming process to form the metal frame, the metal frame having:

(i) width, height and length dimensions;

(ii) an insertion end including first and second opposing sides extending in the width and length dimensions, third and fourth opposing sides extending between the first and second sides in the height and length dimensions, an end surface extending in the width and height dimensions at a distal end of the insertion end between the first and second opposing sides and between the third and fourth opposing sides, and a third opening extending in the width and height dimensions opposite the end surface at a proximal end of the insertion end, wherein the first side includes a first portion that extends from the third opening to the first opening along the entire width of the first side and the second side includes a second portion that extends from the third opening to the second opening along the entire width of the second side; and (iii) a flanged end including a flange opening that communicates with a cavity that extends in the length, width and height dimensions from the flanged end into the insertion end; and thereafter, laser cutting, machining or stamping a first opening in the first side and a second opening in the second side, the first opening being registered with the second opening.

14. The method of claim 13 wherein the sheet metal forming process is deep drawing.

15. The method of claim 13 wherein the sheet metal forming process includes deep drawing and stamping.

16. The method of claim 15 wherein the stamping step comprises:

inserting a mandrel sized to form the insertion end into the cavity; and pressing portions of the metal frame corresponding to material that will form the insertion end against the mandrel using a stamping machine to form the insertion end.

17. The method of claim 15 wherein the stamping step is used to form the flanged end.

18. The method of claim 13 wherein the sheet metal forming process includes deep drawing and cold heading.

19. The method of claim 18 wherein the deep drawing step is used to form the insertion end and the cold heading step is used to form the flanged end.

20. A method of manufacturing a frame for an electrical plug connector, the method comprising:

using zinc die casting to form the frame, the frame having:

(i) width, height and length dimensions;

(ii) an insertion end including first and second opposing sides extending in the width and length dimensions, the first side including a first opening and the second side including a second opening registered with and opposite the first opening, third and fourth opposing sides extending between the first and second sides in the height and length dimensions, an end surface extending in the width and height dimensions at a distal end of the insertion end between the first and second opposing sides and between the third and fourth opposing sides, and a third opening extending in the width and height dimensions opposite the end surface at a proximal end of the insertion end, wherein the first side includes a first portion that extends from the third opening to the first opening along the entire width of the first side and the second side includes a second portion that extends from the third opening to the second opening along the entire width of the second side; and (iii) a flanged end including a flange opening that communicates with a cavity that extends in the length, width and height dimensions from the flanged end into the insertion end past the first and second openings.

21. The method of claim 1 wherein the height of the flanged end is greater than the height of the insertion end such that when the flanged end is assembled with the insertion end, a first lip extends between the insertion end and the flanged end at the first side of the insertion end and a second lip extends between the insertion end and the flanged end at the second side of the insertion end.

* * * * *